US011282346B2

(12) United States Patent
Smart et al.

(10) Patent No.: US 11,282,346 B2
(45) Date of Patent: Mar. 22, 2022

(54) ARCADE GAME WITH RFID READER AND OPTION TO REDEEM POINTS FOR ADDITIONAL PLAYS

(71) Applicant: Smart Industries Corporation, Des Moines, IA (US)

(72) Inventors: Jeffrey T. Smart, Altoona, IA (US); Jimmy G. Dupree, Jr., Des Moines, IA (US)

(73) Assignee: Smart Industries Corporation, Des Moines, IA (US)

( * ) Notice: Subject to any disclaimer, the term of this patent is extended or adjusted under 35 U.S.C. 154(b) by 0 days.

(21) Appl. No.: 16/272,767

(22) Filed: Feb. 11, 2019

(65) Prior Publication Data

US 2019/0251795 A1 Aug. 15, 2019

Related U.S. Application Data

(60) Provisional application No. 62/628,282, filed on Feb. 9, 2018.

(51) Int. Cl.
*G07F 17/32* (2006.01)

(52) U.S. Cl.
CPC ..... *G07F 17/3297* (2013.01); *G07F 17/3209* (2013.01); *G07F 17/3248* (2013.01); *G07F 17/3251* (2013.01)

(58) Field of Classification Search
None
See application file for complete search history.

(56) References Cited

U.S. PATENT DOCUMENTS

| | | | | |
|---|---|---|---|---|
| 6,139,429 | A * | 10/2000 | Shoemaker, Jr. | A63F 9/24 273/448 |
| 6,283,475 | B1 | 9/2001 | Stubben | |
| 6,770,001 | B1 * | 8/2004 | Shoemaker, Jr. | A63F 9/30 273/448 |
| 6,899,337 | B2 * | 5/2005 | Fisher | A63F 9/30 273/447 |
| 8,251,369 | B2 | 8/2012 | Verstraeten | |
| 2003/0151202 | A1 * | 8/2003 | Fisher | A63F 9/30 273/447 |
| 2004/0048659 | A1 * | 3/2004 | Seelig | G07F 17/3267 463/25 |
| 2005/0043073 | A1 * | 2/2005 | Shoemaker, Jr. | G07F 17/3248 463/7 |
| 2005/0119041 | A1 * | 6/2005 | Berman | G07F 17/32 463/16 |
| 2006/0170164 | A1 | 8/2006 | Watanabe | |
| 2011/0272887 | A1 | 11/2011 | McGrath | |

(Continued)

OTHER PUBLICATIONS

Ticket-Smarts, https://www.youtube.com/watch?v=DMW_kY07vDs, published on Nov. 2, 2016, viewed on Internet on Jul. 22, 2019.

(Continued)

*Primary Examiner* — Dmitry Suhol
*Assistant Examiner* — Alex F. R. P. Rada, II
(74) *Attorney, Agent, or Firm* — McKee, Voorhees & Sease, PLC

(57) ABSTRACT

An arcade game permits a player to capture physical prizes using an electro-mechanical device, whereby the prizes are assigned point values, and the point values may be redeemed both to play the game and to collect awards, such as tickets.

19 Claims, 30 Drawing Sheets

(56) References Cited

U.S. PATENT DOCUMENTS

| | | | | |
|---|---|---|---|---|
| 2012/0129592 | A1* | 5/2012 | Walker | G07F 17/3244 463/25 |
| 2012/0228828 | A1* | 9/2012 | Riggles | G07F 17/3251 273/447 |
| 2017/0109970 | A1* | 4/2017 | Stimac | G07F 17/3248 |
| 2018/0137718 | A1* | 5/2018 | Smart | A63F 9/24 |
| 2018/0330577 | A1* | 11/2018 | Shoemaker, Jr. | A63F 9/0079 |

OTHER PUBLICATIONS

Arcade, Matt, "Ticket Time Claw Machine Wins!", YouTube, posted Jun. 11, 2017; downloaded from https://www.youtube.com/watch?v=vCec5OH3bzl on Apr. 29, 2021.

* cited by examiner

GAME CONFIGURATION

| | | | |
|---|---|---|---|
| 1 | points_per_play | Minimum number of points to start playing | 50 |
| 2 | points_per_ticket | Points per ticket Redeemed | 100 |
| 3 | min_cash_out | Minimum points to allow redeem | 100 |
| 4 | max_cash_out | Maximum points to allow redeem at once | 500 |
| 5 | add_currency_time | Time to wait for money after playing (0 -- no timeout) | 0 |
| 6 | super_win | Points for super win screen | 500 |
| 7 | blockbuster_win | Points for blockbuster win screen | 2000 |
| 8 | auto_nudge | Timeout on attract screen to show nudge screen (0=no timeout) | 120 |
| 9 | game_ext_time | Time to allow for scanning for size at end of game | 12 |
| 10 | small_mulitplier | Multiple for 5X button | 2 |
| 11 | big_multiplier | Multiple for 10X button | 5 |
| 12 | points_per_bill_pulse | Points per pulse from Bill Accepter | 25 |
| 13 | points_per_coin_pulse | Points per pulse from Coin Accepter | 25 |
| 14 | leftover_flag | When ON allows leftover points to play for a free play | ON |

Use Redeem Points (Up), Play Points buttons (Down)

Use Insert Money Button to Select

| | |
|---|---|
| **Firmware Version:** | **0.12** |
| **Restore Defaults** | **Exit** |

*FIG. 27*

ARCADE GAME WITH RFID READER AND OPTION TO REDEEM POINTS FOR ADDITIONAL PLAYS

PRIOR APPLICATION

This application claims priority to U.S. Provisional Application No. 62/628,282 filed Feb. 9, 2018; which application is hereby incorporated in its entirety.

FIELD OF THE INVENTION

The invention relates generally to arcade games. More specifically, the invention relates to arcade games where a player captures a physical prize.

BACKGROUND OF THE INVENTION

Crane-style arcade games have an electronic control system and a mechanical system that allows a player to purchase a chance to capture a prize by skillful manipulation of player controls. The controls include a joystick and/or buttons. These controls allow the player to move a crane head in front/back and left/right directions above a supply of prizes and then drop a claw which will pick up prize merchandise if skillfully and properly manipulated. When the claw drops to the bottom of its travel, the electronic control system closes the claw. The closing of the claw may grasp one or more prizes, or may remain empty. The control system then raises the claw, positions it over a prize delivery chute and releases any prizes held by the claw. Motors are used to move the crane head and to move the claw up and down. The claw is activated by a solenoid. The equipment operator can preset the nominal strength of the claw solenoid to adjust the skill level required to win. A stronger force applied by the claw generally increases the chances that a prize will be grasped; whereas a lower force makes winning prizes more difficult. Operators will therefore set the gripping strength at a level that maximizes profit by rewarding play without costing too much in prizes. The strength level may be variable within a session to encourage repeated play, for example by increasing as more money is spent on playing.

Traditionally, crane-type arcade games are filled with a number of different prizes, toys or other novelty items. For example, the game may include stuffed animals, sport balls, baseball hats, plastic football/baseball helmets, stickers, jewelry, etc. The user would then manipulate the crane or arm as described above over the desired prize within the game and elect to deploy the crane or arm to try and grab the prize. If the crane successfully picked up the prize, the prize would be dispensed to the user/player. The user could then make use of the item they won.

However, developments in the arcade gaming industry have led to changes in how prizes are managed and the types of prizes included in many arcades. One common arrangement is for players to be awarded tickets by various games within an arcade. A player can accumulate tickets from many different arcade games, and then redeem the tickets for a variety of prizes that are assigned ticket values. For this reason, crane games have been developed where the prizes, such as toys and novelty items have been replaced by rolls of tickets or other physical items that are marked with a ticket value. However, these tickets or may be lost, stolen, or misplaced. Furthermore, there is a need to store the redeemed tickets at the validation site and return the tickets to the machine at a later time. Due to being handled by users the tickets tend to rather quickly degrade and become unusable, requiring frequent replacement of the tickets.

While electronic video games have commonly allowed players to accrue points and redeem those points to replay the game or acquire tickets, arcade games that include electro-mechanical capture of physical prize have not had the option.

It can be desirable for a game operator to encourage additional plays of the game. Likewise, players may enjoy playing a game multiple times without the need to provide additional payment for the plays.

Therefore, there remains a need in the art for an apparatus and/or method for efficiently and economically managing various types of prizes within the industry.

SUMMARY OF THE INVENTION

Therefore, it is a primary object, feature, and/or advantage of the invention to improve on and/or overcome the deficiencies in the art.

According to one embodiment the invention relates to an arcade game that includes an electro-mechanical prize-capturing device. The prize-capturing device is used to capture one or more prizes from a playing field. The arcade game includes a computer processor that calculates and stores a point total for each game session. Each prize has a readable marker that is associated with a point value. The game includes a reader that reads the point value of the readable markers on captured prizes. The game includes a display to show the point total for a game session. The point total for a game session is equal to a starting point total minus points redeemed for additional turns during a session plus the point values to any prizes captured during the playing session. A player may redeem a portion of the point total for an award and may redeem any remaining portion of the point total for one or more additional plays of the game. The electro-mechanical prize-capturing device may be a crane with a grabber mechanism that can be manipulated in an X-Y plane by a player with a joystick. The prizes may be rolls of tickets. The markers may be RFID tags and the reader may be an RFID reader. The award may be tickets, or an electronic ticket value written to a player's swipe card or other memory device. A multiplier button may be provided to permit a player to select a multiple play whereby a multiple deduction from the point total is made for each play of the game and the point value of each prize captured is multiplied by a multiplier before being added to the point total.

According to one embodiment, the present invention relates to a crane-style arcade game that has an enclosed prize chamber in a housing including a floor for supporting prizes. The prizes have RFID tags with assigned point values. A grabber mechanism is suspended above the floor. A controller is located externally on the housing and has a connection to the grabber mechanism to permit a player to control a position of the grabber mechanism above the floor whereby the player attempts to capture a prize from the prize chamber with the claw and drop the prize into an opening in the floor. An RFID reader associated with the opening in the floor reads the RFID tag on a captured prize as the captured prize is moved past the RFID reader. A recording device connected to the RFID reader records the assigned point values of the RFID tags of captured prizes read by the RFID reader. The controller may be adapted to drop the prize into the opening in the floor by releasing the prize from the claw when the grabber mechanism is above the opening. The crane-style arcade game may also include a captured-prize storage area below the floor and a delivery passage within the housing in communication between the opening in the floor and the captured-prize storage area. The captured-prize storage area may be entirely enclosed within the housing. The crane-style arcade game may also have a rotary unit within the delivery passage, with the rotary unit positioned in communication with the opening in the floor to move the captured prizes past the RFID reader towards the captured-prize storage area. The rotary unit may include a rotary table guide, wherein the rotary table guide has: (a) a rotary guide base having an aperture proximate to the center of the rotary guide base; (b) one or more interior walls positioned within the aperture of the rotary guide base, the interior walls being configured to define the aperture into quadrants; (c) one or more doors operatively attached to the one or more interior walls; (d) an exterior wall attached proximate to an outer edge of the aperture; and (e) a sloped portion of the rotary guide base configured to funnel a captured prize to the aperture. The rotary unit may also include a rotary base having (a) a rotary table base; (b) a motor; (c) a hub assembly positioned above the rotary base and operatively attached to the motor; and (d) one or more arms extending from the hub assembly. The RFID reader may be attached proximate to the rotary table base. The motor may be configured to rotate the hub assembly and the one or more arms to move the captured prize about the rotary table, whereby the RFID reader reads the RFID tag on the captured prize. The recording device may be adapted to record point values to a user's memory card. The prizes may be rolls of ticket. The point value assigned to each RFID tag may correspond with a number of tickets in the ticket roll to which the RFID tag is attached.

According to another embodiment, the present invention is a rotary base for an arcade game. The rotary table guide includes a rotary guide base having an aperture proximate to the center of the rotary guide base. One or more interior walls are positioned within the aperture of the rotary guide base and define the aperture into quadrants. One or more doors are operatively attached to the one or more interior walls. An exterior wall is attached proximate to an outer edge of the aperture. A sloped portion of the rotary guide base is configured to funnel an item to the aperture. A rotary table is positioned below the rotary table guide. The rotary table has: a rotary table base; a motor; a hub assembly positioned above the rotary base and operatively attached to the motor; and one or more arms extending from the hub assembly. The rotary base may also include an RFID reader attached proximate to the rotary table base. The motor may be configured to rotate the hub assembly and the one or more arms to move an item having an RFID tag about the rotary table, whereby the RFID reader may identify the item from the RFID tag. The one or more doors may be configured to separate and position one or more items flatly on the rotary table base. The one or more arms may be bent, curved, and/or angled to allow the one or more arms to cradle one or more items placed on the rotary table base as the hub assembly is rotated.

According to another embodiment, the present invention is a method of operating an arcade game by placing one or more prizes each having an RFID tag on a rotary base that has a hub assembly and one or more arms extending from the hub assembly. An RFID reader is attached proximate to the rotary base. The hub assembly is rotated to move the one or more prizes along the rotary base, wherein the RFID tag on each of the one or more prizes may be read by the RFID reader. The RFID tag on each of the one or more prizes may be assigned a point value and the RFID reader may be configured to calculate the point value of the RFID tag on each of the one or more prizes that is read by the RFID reader. The prizes may be rolls of tickets and the point value of each RFID tag corresponds with a number of tickets in the roll to which each RFID tag is attached.

It is still yet a further object, feature, and/or advantage of the invention to provide an arcade game wherein the one or more items or prizes are completely enclosed within the housing during game play.

These and/or other objects, features, and advantages of the invention will be apparent to those skilled in the art. The invention is not to be limited to or by these objects, features and advantages. No single embodiment need provide each and every object, feature, or advantage.

BRIEF DESCRIPTION OF THE DRAWINGS

FIG. 27 shows a game configuration screen that is used by a game operator to set various parameters of the game;

DETAILED DESCRIPTION

Figure 1:
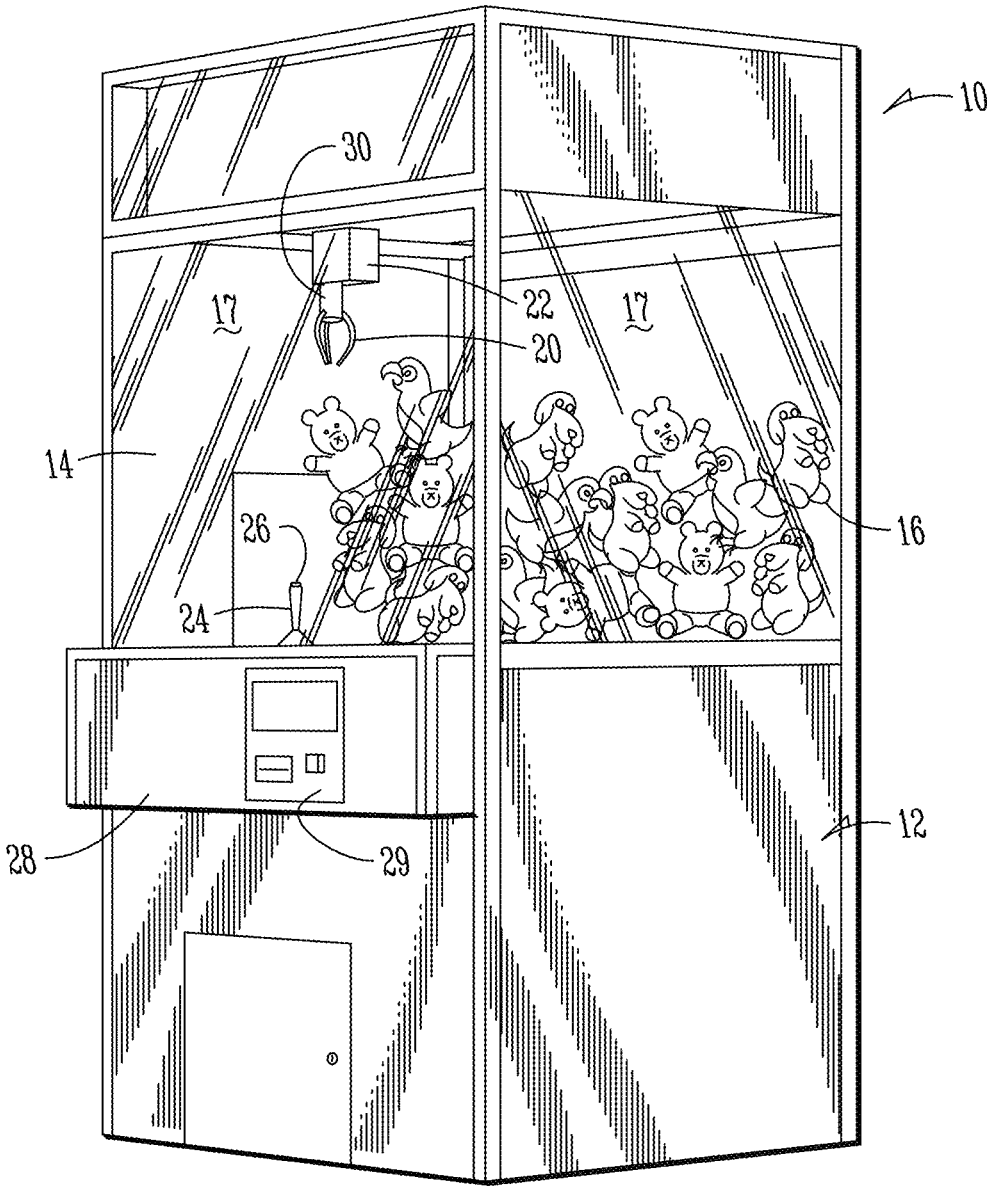
FIG. 1 is a perspective view of a crane-style game according to one embodiment of the present invention.

The invention is directed towards an arcade game 10, and more specifically but not exclusively toward a crane-style arcade game. Unlike traditional crane-style games, the game 10 of FIG. 1 does not include a chute for a player to retrieve a prize that has been grasped and released by the crane. Instead, the prizes remain in the housing. Each prize includes an RFID marker and that gets read by an RFID reader. After a prize is "won" by being grasped by the crane, the prize value is read by the RFID reader and credited to the player.

According to one feature (see FIGS. 14-26), an arcade game 300 may permit a player to capture physical prizes using an electro-mechanical device, whereby the prizes are assigned point values, and the point values may be redeemed both to play the game and to collect awards, such as tickets. The arcade game 300 includes a video display screen 310 that keeps track of the total prize value accumulated during a single play of the game. For example, if a player has successfully captured three prizes worth 75, 150, and 50 points respectively, the video display screen 310 would show that the player has won 275 points. The display screen may also show how many plays the player has remaining. The player may redeem those points for tickets, or, may redeem some of those points for additional plays of the game. For example, if the "price" of a ticket is set at five (5) points and the price of a replay is set at twenty-five (25) points, a player could redeem 200 of the points for forty (40) tickets and the remaining seventy-five (75) points could be redeemed to play the game three (3) more times. A game operator can set the price, or point-value, of the tickets and game play as desired. According to some embodiments, a player is awarded points upon the insertion of money or other payment, such that upon initiating play a player starts with a point balance and any point value of selected prizes is added to the initial points, less any points redeemed to play the game.

Referring to FIG. 1, a crane game 10 is shown. A crane-style game may include a housing 12 that defines an enclosed chamber 14 with prizes 16 inside distributed therein. While the prizes 16 shown in FIG. 1 are shown as stuffed animals, other types of prizes are also contemplated, including specifically rolls of tickets. Transparent windows 17 of housing 12 may allow a player to view prizes 16 without having direct access to them. A claw 20 or other grabbing mechanism is connected to a crane 22. The claw 20 may include a number of different types of grabbing mechanisms. For example, the claw 20 may include a magnet, arms, fingers, pincher, or similar mechanism for grabbing or attaching to a prize 16 within the chamber 14. As is well-known in the art, a player control 24 (e.g. joy stick, arrow buttons, keypad) is used by a player to move the crane 22 in an x-y plane (generally horizontal) relative to the prizes 16 within chamber 14. The player selects a prize(s) 16 that they hope to collect and attempts to position the claw 20 vertically over the selected prize(s) 16. Another manual player control, such as button 26 causes the crane 22 to drop claw 20 down with the claw jaws open, close the jaws, and lift claw 20 upward. The button 26 may be part of or incorporated into the player control joy stick 24 if the skill of the operator at positioning claw 20 is successful and the claw 20 drops in such a position that its jaws grasp at least a portion of prize 16, and the jaws grasping strength is sufficient to hold prize 16 when lifted, the operator either moves crane 22 to a position, or game 10 automatically moves crane 22 to a position where claw 20 would open and drop prize 16. A solenoid 30 controls the opening and closing of the claws 20 and may be of variable strength to make holding on to prizes easier or more difficult depending on a desired winning percentage. These features are shared by many traditional crane-style games as shown and described in U.S. Pat. Nos. 6,283,475 and 8,251,369, which are herein incorporated by reference in their entirety.

A payment handler 29, such as a coin receiver and changer or a card reader and writer, is incorporated on a console 28. A player deposits an appropriate amount of money or has an appropriate amount of money or credit deducted from a card, to have a chance at obtaining a prize 16. The game may also be activated by RFID, which may include a number of credits or points that are subtracted with each play of the game 10.

Unlike traditional crane-style games, the game 10 of FIG. 1 does not include a chute for a player to retrieve a prize 16 that has been grasped and released by the crane 22. Instead, the prizes 16 remain in the housing 12. Each prize 16 includes an RFID tag 102 (see FIG. 13) and that gets read by an RFID reader 82 (FIGS. 2-7, 11, and 12).

Referring to FIGS. 2-7, a rotary unit 40 is installed in the housing 12 of an arcade game 10 is shown. The rotary 40 unit may be sized or retrofitted to fit within any arcade game 10. The rotary unit 40 includes a rotary table guide base 50 (see FIG. 9). The guide base 50 rests on a support platform 70 (see FIG. 10). Rotary arms 74 rotate at the bottom of the guide base 50 to move a selected prize 17 past the RFID reader 82 and then to aperture 78 in the support platform 70 where the selected prize 17 drops into a holding area 88.

Figure 3:
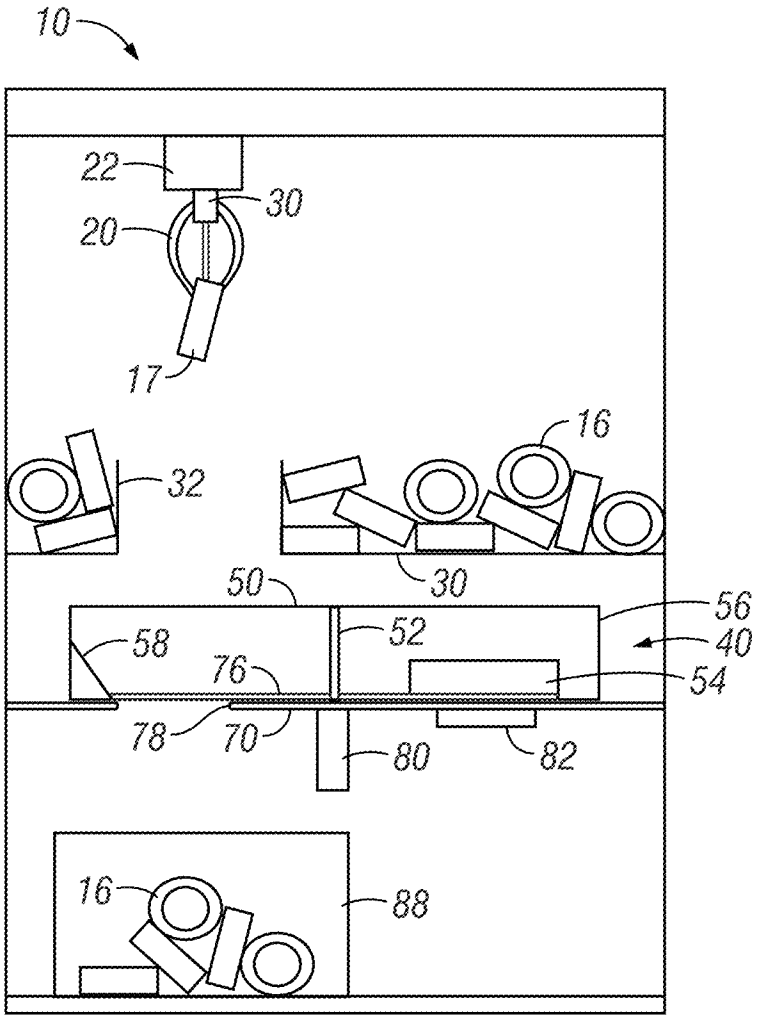
FIG. 3 is the crane-style game of FIG. 2 wherein the crane has picked up a prize that has an RFID tag attached.
Figure 9:
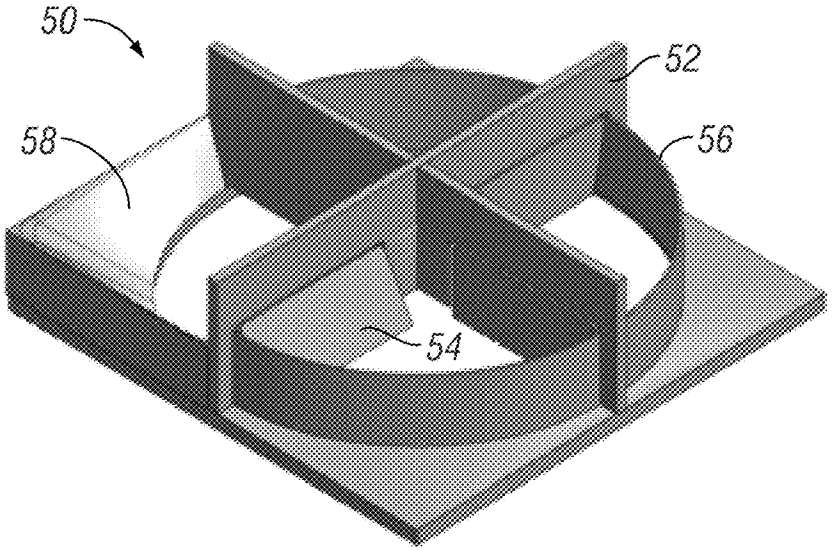
FIG. 9 is a perspective view of a rotary table guide according to one embodiment of the present invention.

With reference to FIG. 9, the rotary table guide 42 may include a guide base 50 that has both flat and angular portion(s) 58. The base 50 may also include an aperture located proximate to the center of the base 50. Extending from or attached to the base 50 are outer walls 56 and interior walls 52. The outer walls may be attached proximate to the outer edge of the aperture in the base 50. The outer wall 56 may extend in a generally vertical direction or may extend upward and outward from the base 50 to create a funnel like effect to the aperture. Interior wall(s) 52 may extend in a generally vertical direction or may be angled to funnel an item to a particular quadrant 55A, 55B, 55C, 55D of the aperture in the base 50. The interior wall(s) 52 may also include cut-out portions that act as guides to orient and singulate prizes that are on the rotary base 72 as they are moved through the walls 52. The interior walls 52 may include a door 54 or flap at the cut-out portions. The door 54 may be attached to the interior wall 52 by a hinge, pin, or other similar mechanical device for attaching a swing door or flap. The door(s) 54 may be configured to rotate about a generally vertical or a generally horizontal axis. The example embodiment in FIG. 3 represents a rotary table guide 42 that includes four interior walls 52, three of which have doors 54. The rotary table guide 42 of FIG. 3 also includes an angled portion 58 of the base 50. The angled portion 58 may be configured to funnel an item or object into quadrant 55D of the aperture of the base 50 that is defined by the interior walls 52. This will be explained in greater detail below. A rotary base 72 may be placed on top of the rotary platform 70 with an aperture or cutout portion 73 located in the first quadrant 55A of the rotary table guide 42. Prizes 16 may be stored within the chamber 14 on top of the floor member above the rotary table guide 42.

Figure 10:
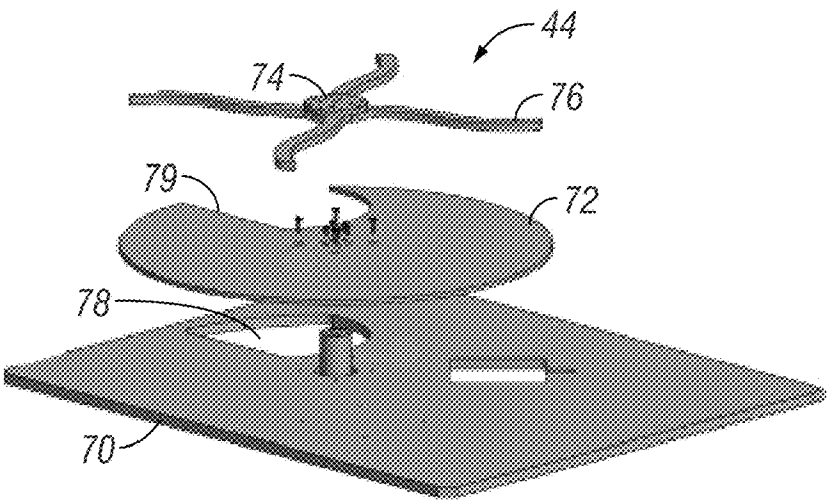
FIG. 10 is an exploded view of a rotary table base according to one embodiment of the present invention.

Referring to FIG. 10, an example embodiment of a rotary table 44 is shown. The rotary table 44 is configured to be positioned below the rotary table guide 50. One or more apertures 78 may be cut in the platform/floor 70 of the chamber 14. The aperture 78 may be configured to create an opening to permit a selected prize to fall to the holding area 88. Apertures may also be provided to mount a motor 80, mount an antenna 86, and/or mount an RFID reader 82 or similar scanning and sensor-type mechanism. The RFID reader 82 may be attached to the platform 70 by one or more mounting brackets (not shown). On top of the platform is the rotary base 72. The rotary base 72 may have an outer radius approximately the size of the aperture in the rotary table guide 42. The rotary base 72 may also include a cutout portion 79. The cutout portion 79 is configured to align with the aperture 78 in the platform 70 configured to receive a prize 16 or other item. However, the base may be stationary and the shaft of the motor 80 configured to pass through the rotary base 72. On top of the rotary base 72 may be a rotary arm hub assembly 74 comprising one or more arm portions 76. The arms 76 may be constructed of a plastic, metal alloy, carbon fiber, or another material with similar mechanical properties. However, in a preferred embodiment it may be advantageous to have the arms 76 constructed of a light yet rigid and durable material to reduce the load on the motor while still having sufficient rigidity to push an object 16 around the rotary base 72. The hub assembly 74 may be configured to be operably attached to the motor 80, wherein the motor 80 is configured to rotate the hub assembly 74. The arms 76 may be curved, bent, or angled to grab, secure, or hook a prize that has been dropped/placed on the rotary base 72. For example, the arm may be curved so as to cradle a round prize/object 16 such as a ball or disk and move it about the rotary base 72 as the hub assembly 74 is rotated. In one embodiment, a low RPM motor 80 may be utilized to allow for the RFID reader 82 to read an RFID tag or marker 102 attached to a prize 16 or ticket roll 100.

Figure 2:
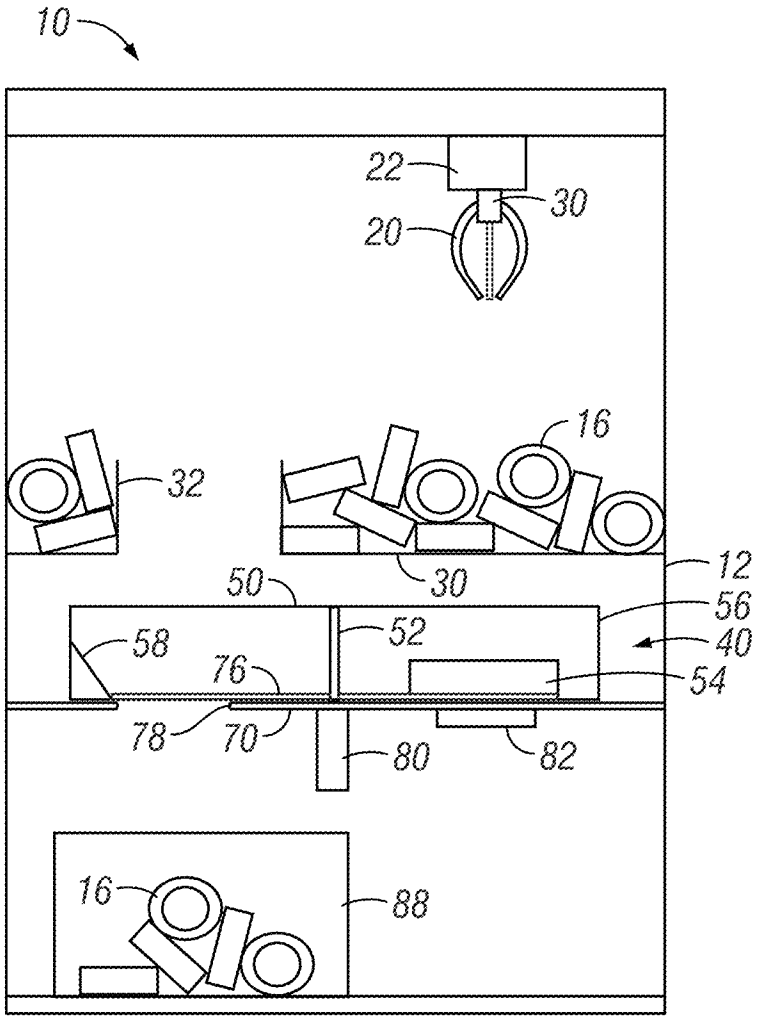
FIG. 2 is a cross-sectional representation of a crane-style game according to one embodiment of the present invention with the crane in a resting position before game play.
Figure 5:
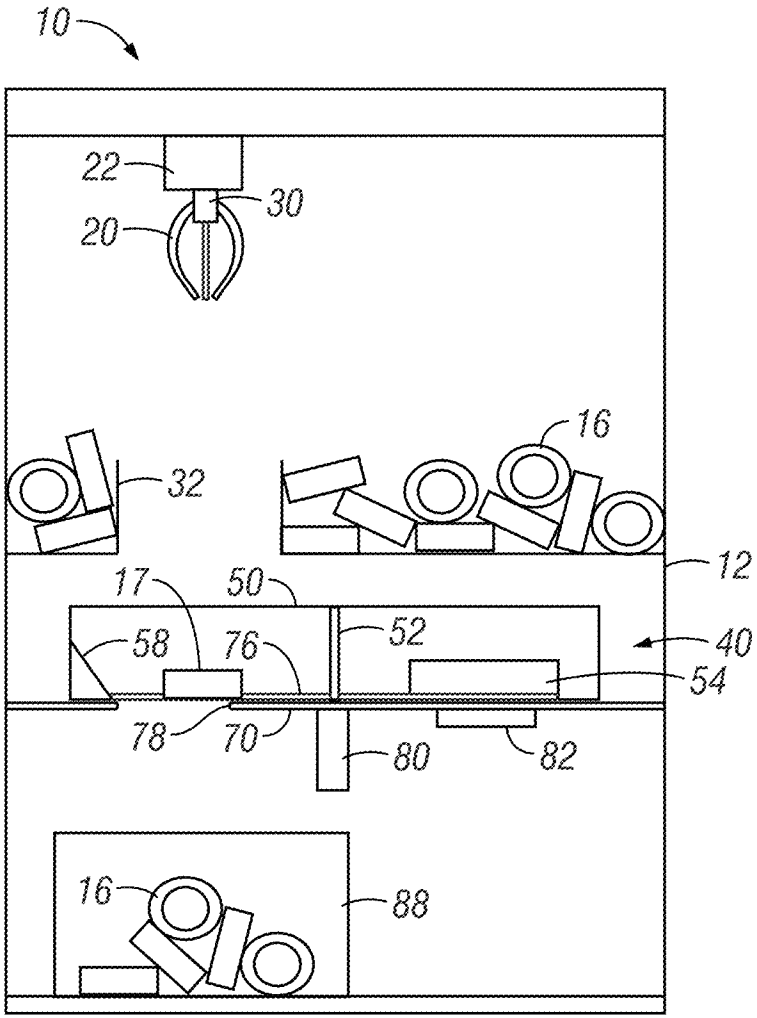
FIG. 5 is the crane-style game of FIG. 4 wherein the dropped prize is resting on a rotary table base.
Figure 4:
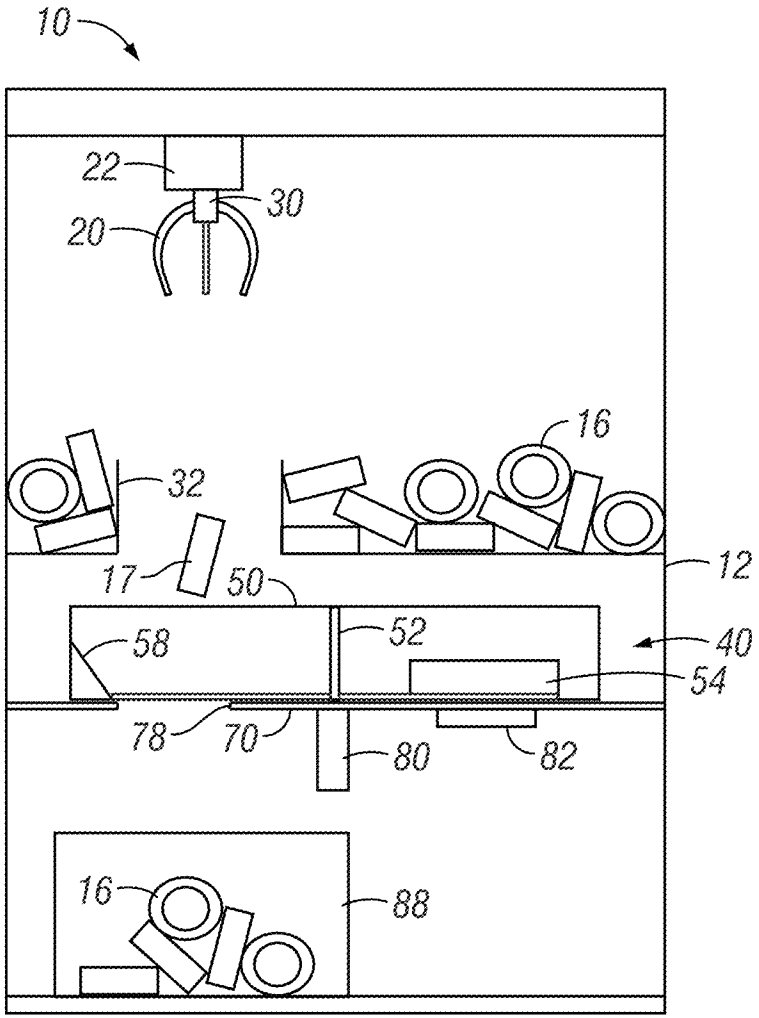
FIG. 4 is the crane-style game of FIG. 3 wherein the crane has dropped the prize.
Figure 7:
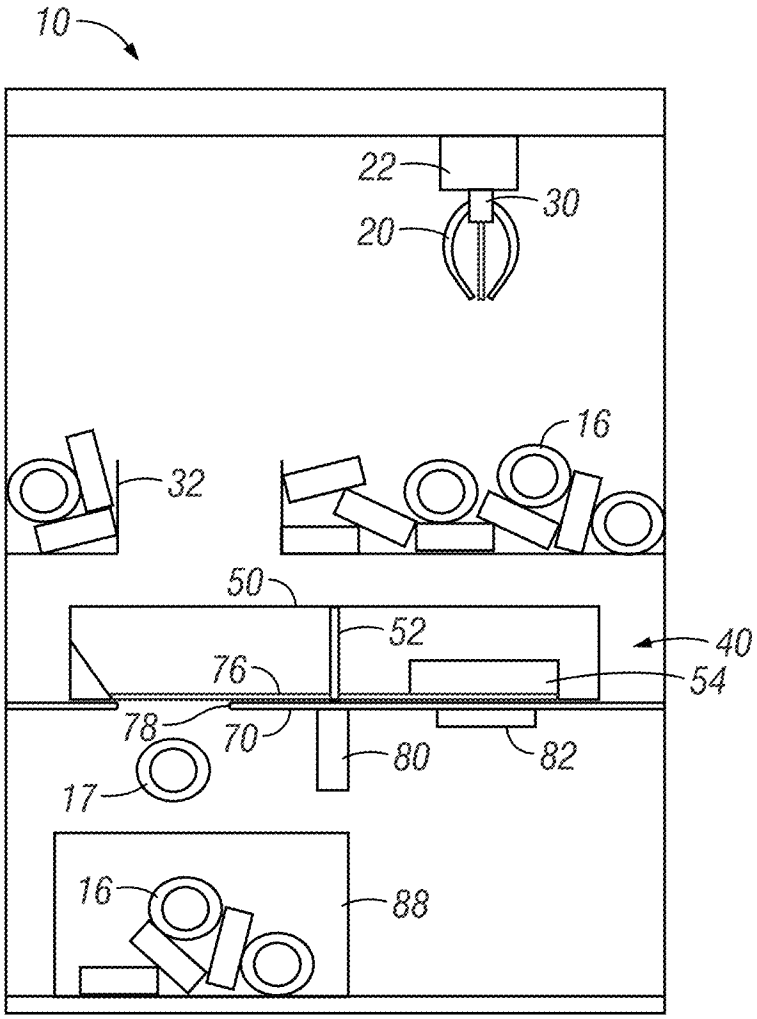
FIG. 7 is the crane-style game of FIG. 6, wherein the rotary table has rotated even further to drop the dropped prize towards a storage area.
Figure 6:
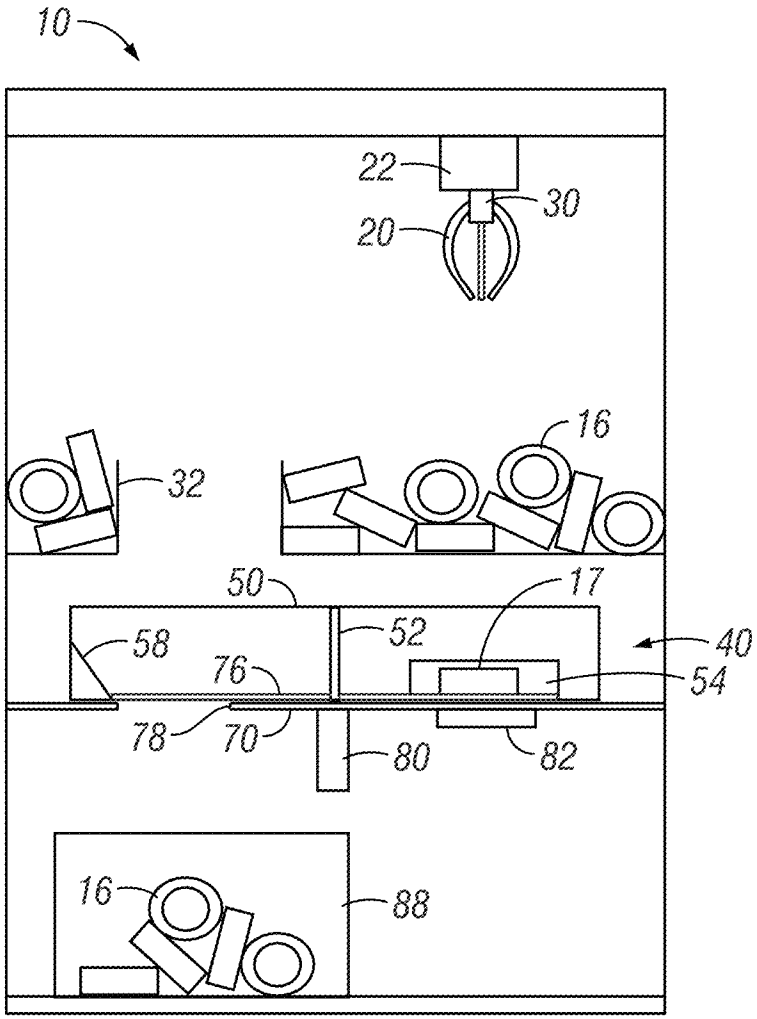
FIG. 6 is the crane-style game of FIG. 5 wherein the rotary table has rotated such that the dropped prize is in close proximity to the RFID reader.
Figure 8:
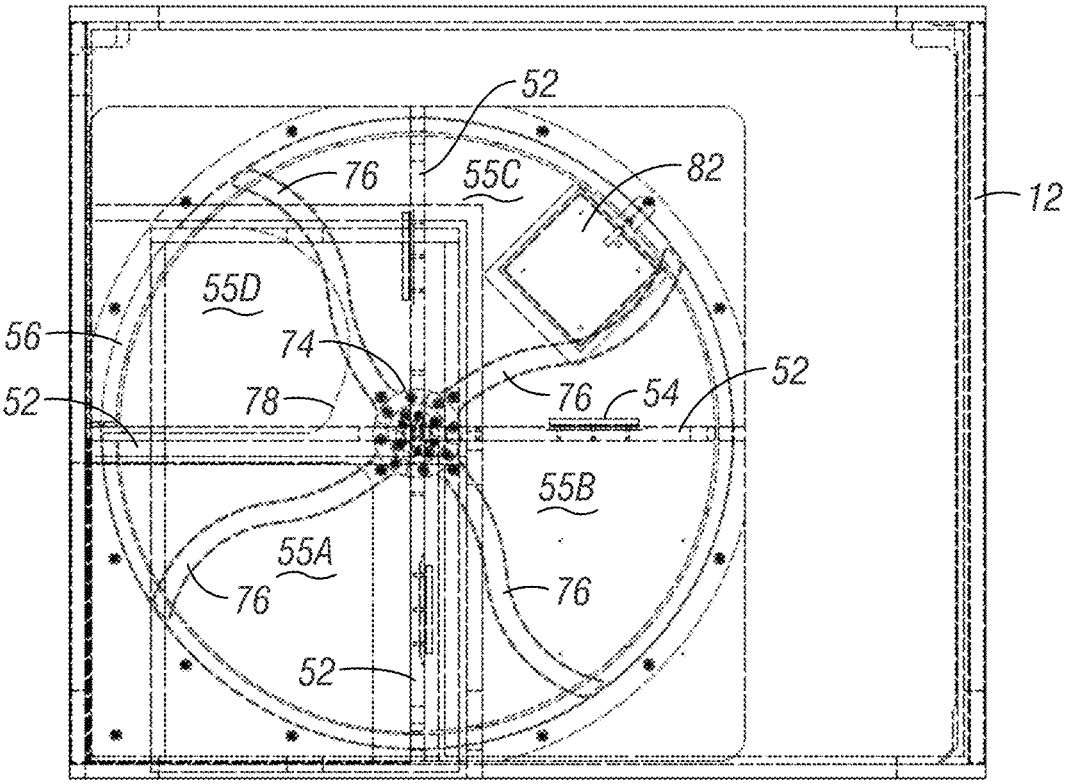
FIG. 8 is a lower plan view of a rotary table according to one embodiment of the present invention.

In FIG. 2, the game 10 is in a default resting position, ready for play. The claw or grabbing mechanism 20 is above the prizes 16. The prizes rest on a floor 30. In FIG. 3, the grabbing mechanism 20 has grasped a selected prize 17 and moved it over an opening 32 through the floor 30. In FIG. 4, the grabbing mechanism 20 has released the selected prize 17 so that it drops through opening 32 toward the rotary unit 40, specifically toward quadrant 55A formed by walls 52 on the rotary guide 50. In FIG. 4, the selected prize 17 is resting on the platform 70 (or rotary base 72) in the first quadrant 55A. In FIG. 5, the rotary arm 76 has been rotated by motor 80 to move the selected prize 17 through the cut-out in the wall 52. The curved shape of the arms 76 urges the prize 17 into alignment with the cut-out. The cut-out will orient the prize 17 by knocking it flat on the platform 70 and in case two (or more) prizes were dropped, will singulate the prizes. In FIG. 6, the arms 76 have rotated the prize 17 further into alignment with the RFID reader 82. The RFID reader 82 will read the prize value from the RFID tag 102. In FIG. 7, the rotary arms 76 have been rotated to move the selected prize over the aperture 78 in the fourth quadrant 55D such that the selected prize 17 falls into a storage area 88. Periodically, the selected prizes 17 can be emptied back into the playing area.

In one example embodiment, in operation, the user may insert money, coins, or may swipe a card through the reader 94 to activate the game 10. The user may then utilize their skill to manipulate the grabber mechanism 20 about an x-y plane within the chamber 14 to position the grabber 20 above the users identified target/prize 16. For example, the user may attempt to grab one or more ticket rolls 100 positioned within the chamber 14. The user may have a predefined or limited amount of time within which to position the grabber 20 before the grabber 20 is activated to attempt to grab the prize 16 or roll 100. It should be understood that the prize 16 and ticket roll 100 may be used interchangeably. They both represent the target item(s) placed within the chamber 14 of the game 10 that the user attempts to grab with the grabber 20. Once the user has positioned the crane using arrow keys or a joy stick 26, the user may press a button 26 to activate the grabber mechanism 20. The grabber 20 will extend down toward the ticket roll 100 and attempt to collect one or more rolls 100. An example method and apparatus for grabbing the prize 16 and/or ticket rolls 100 is described in greater detail in U.S. Pat. No. 6,283,475, which is herein incorporated in its entirety. If the user is successful in collecting one or more rolls 100 with the grabber 20, the crane 22 will lift the rolls 100 and return the crane 22 to the start position. In a game that includes the rotary unit 40 described above, the start position may be located above the first quadrant 55A of the rotary table guide 42. The roll(s) 100 may then be released by the grabber 20 and dropped and funneled into the first quadrant by the angled portion 58 of the rotary table guide 42, where the rolls would be positioned on top of the rotary base 72. The motor 80 may then be activated to rotate the hub assembly 74 and arms 76. The arms 76 may push the roll(s) 100 under the door of the first interior wall 52 that the roll(s) 100 approach, the hinged door 54 may tip over or knock down any ticket rolls 100 that are standing on end. This will insure that the roll(s) 100 are laying flatly on the rotary base 72 as they move along the base 72. Additional interior walls 52 and hinged doors 54 may be utilized to insure all rolls 100 lay flat on the base 72. As the arms 76 move the rolls 100 along the base 72, the rolls will pass over a sensor, antenna, or RFID reader that will scan the RFID tag 102 or other marking device that is attached to each of the rolls 100. A controller or computer may then be configured to add up and/or display the total number of ticket rolls 100 collected. The roll(s) 100 may continue along the base 72 until it reaches the aperture 78 in the floor 70 of the rotary table 44. The ticket roll(s) 100 will then be sent down a chute.

Traditional crane-style arcade games have included an outlet or collection zone where a user could collect any prizes that were won while playing the game. For example, a player may successfully grab a stuffed animal and the crane 22 would release the stuffed animal down a chute to a collection zone 28 where the user could collect their prize 16. It should be understood that the present invention may also be operated in a similar manner wherein the ticket roll(s) may pass through the aperture 78 in the floor 70 of the rotary table 44, where the roll(s) 100 may then be collected by the user. However, it should also be understood that in an alternative embodiment that ticket roll(s) 100 may not be presented to or collected by the user. In this embodiment, the ticket roll(s) 100 may be collected in the bottom portion of the game cabinet 12 that may not be accessed by the user. The points associated with the values of the ticket rolls 100 grabbed by the user may be awarded by placing the points on a card with a magnetic strip. A paper receipt may also be printed with a barcode and/or the amount of points/tickets won by the user. The receipt and/or card may then be taken to the owner/operator of the game to be exchanged for a prize or other item of value. One advantage of this particular method of awarding prizes is that the ticket rolls 100 never leave the game cabinet, therefore that user cannot lose or misplace the ticket roll(s), which the operator would then need to replace. The operator would simply need to open up the game cabinet 12 and place the winning ticket rolls 100 from the lower portion of the cabinet 12 back into the chamber 14.

In an alternative embodiment, once the ticket roll(s) 100 or prize(s) 16 have been identified by the RFID reader, the ticket roll(s) 100 or prize(s) 16 may be placed back in the chamber. This may be accomplished by attaching a chute, fulcrum, elevator, escalator, or similar mechanism to the rotary unit 40, wherein once the item(s) 100 has passed by and been identified by the RFID reader, the chute, escalator, elevator, etc. will place the item(s) 100 back in the chamber 14 and ready for the next game by a user.

Figure 11:
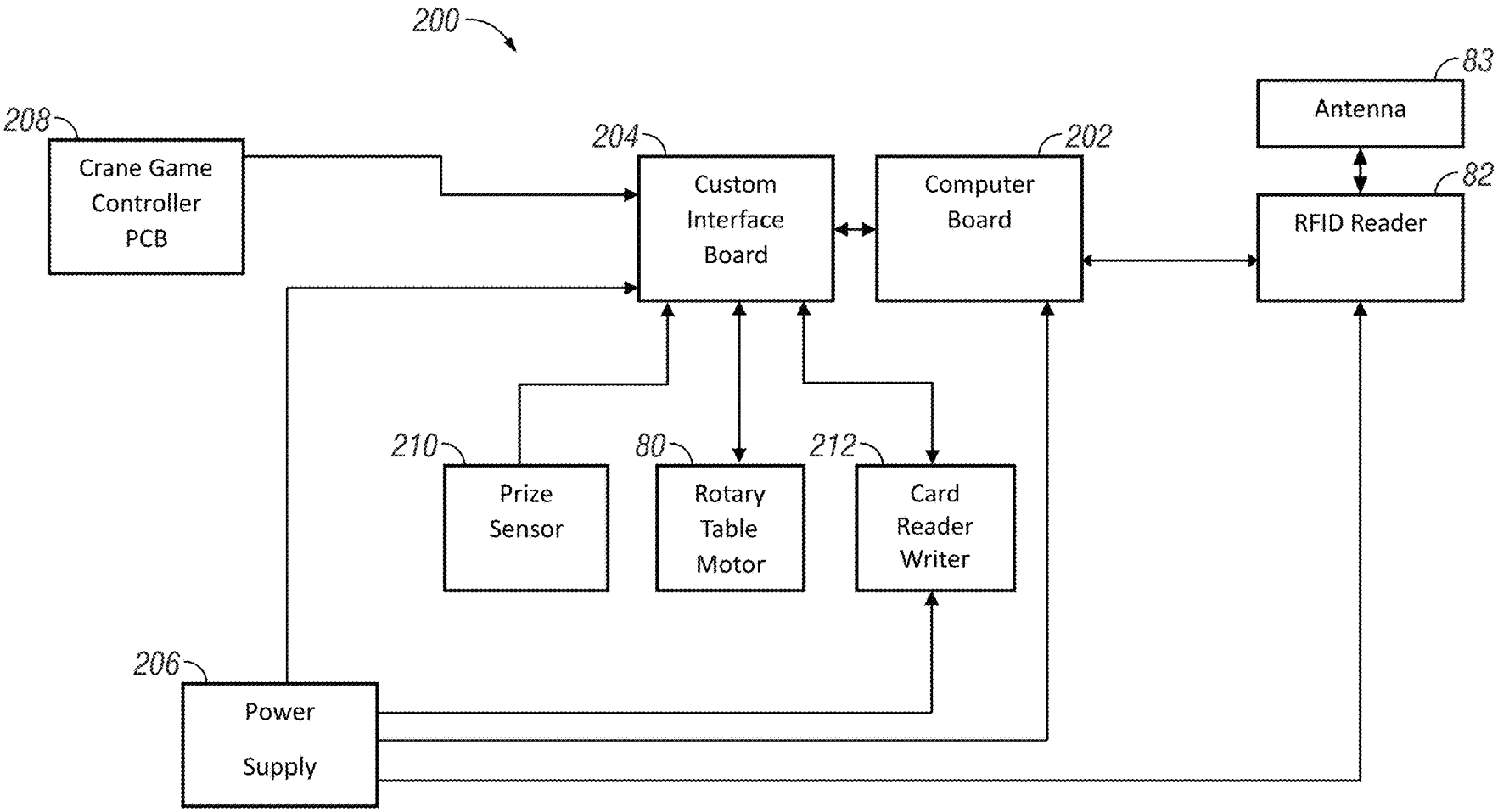
FIG. 11 is a system block diagram for a crane-style game according to one embodiment of the present invention.
Figure 12:
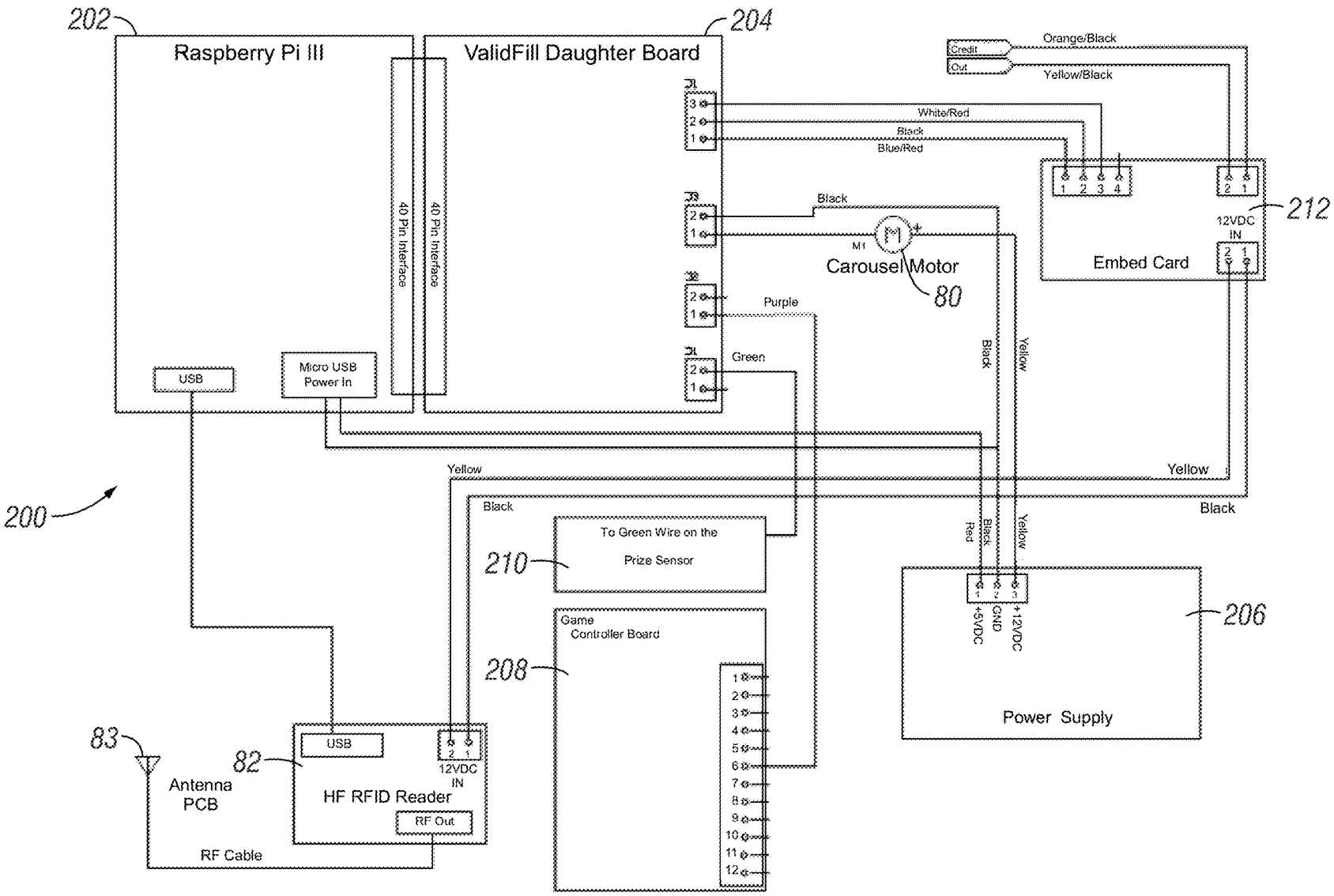
FIG. 12 is an electronics diagram for a crane-style game including RFID game according to one embodiment of the present invention.
Figure 13:
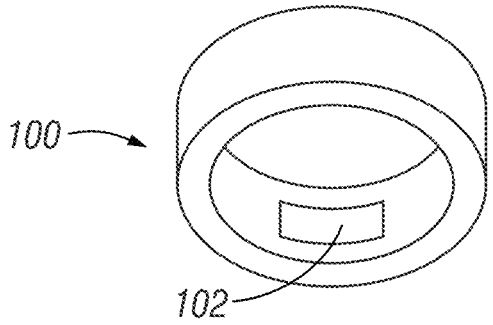
FIG. 13 is a perspective view of a ticket roll with RFID tag for use as a prize in a crane-style game.

FIG. 11 shows a block diagram of the electronic components 200 of the game 10 according to one embodiment. The components are controlled by a primary computer board 202 and a custom interface board 204. The primary computer board may be a programable computer with a forty-pin interface, such as one manufactured under the brand name Raspberry Pi III. The interface board 204 may act as a daughter board to interface between the game components and the primary board 202. A power supply 206 is used to supply power to the various components. The power supply 206 may include a rectifier to convert an AC input to a DC output. In one embodiment the power supply 206 may provide outlets twelve (12) volts and five (5) volts. The controller 208 connects to the interface board 204 to provide an input of the status of the crane game. Additionally, a prize sensor 210 that is part of a standard game provides an input to the interface board 204 to provide a signal when a prize 16 has been won. The computer boards 202 and 204 in response to the signal that a prize has been won cause the rotary table motor 80 to rotate a full revolution to move the selected prize 17 past the RFID reader 82 and eventually to the opening 78 that leads to the storage area 88. The antenna 83 of the RFID reader 82 reads the RFID tag 102 on the prize 17 and provides a signal to the RFID reader 82 that relays a signal the computer board 202 indicating the point or ticket value of the selected prize 17. The computer board 202 may accumulate a total value of points or tickets won during a turn. The custom interface board 204 may then relay the total point or ticket value to a card reader/writer that can transfer the point or ticket value to a user's card, for example a magnetic strip card. FIG. 12 shows a wiring diagram of the electronic components 200.

Figure 14:
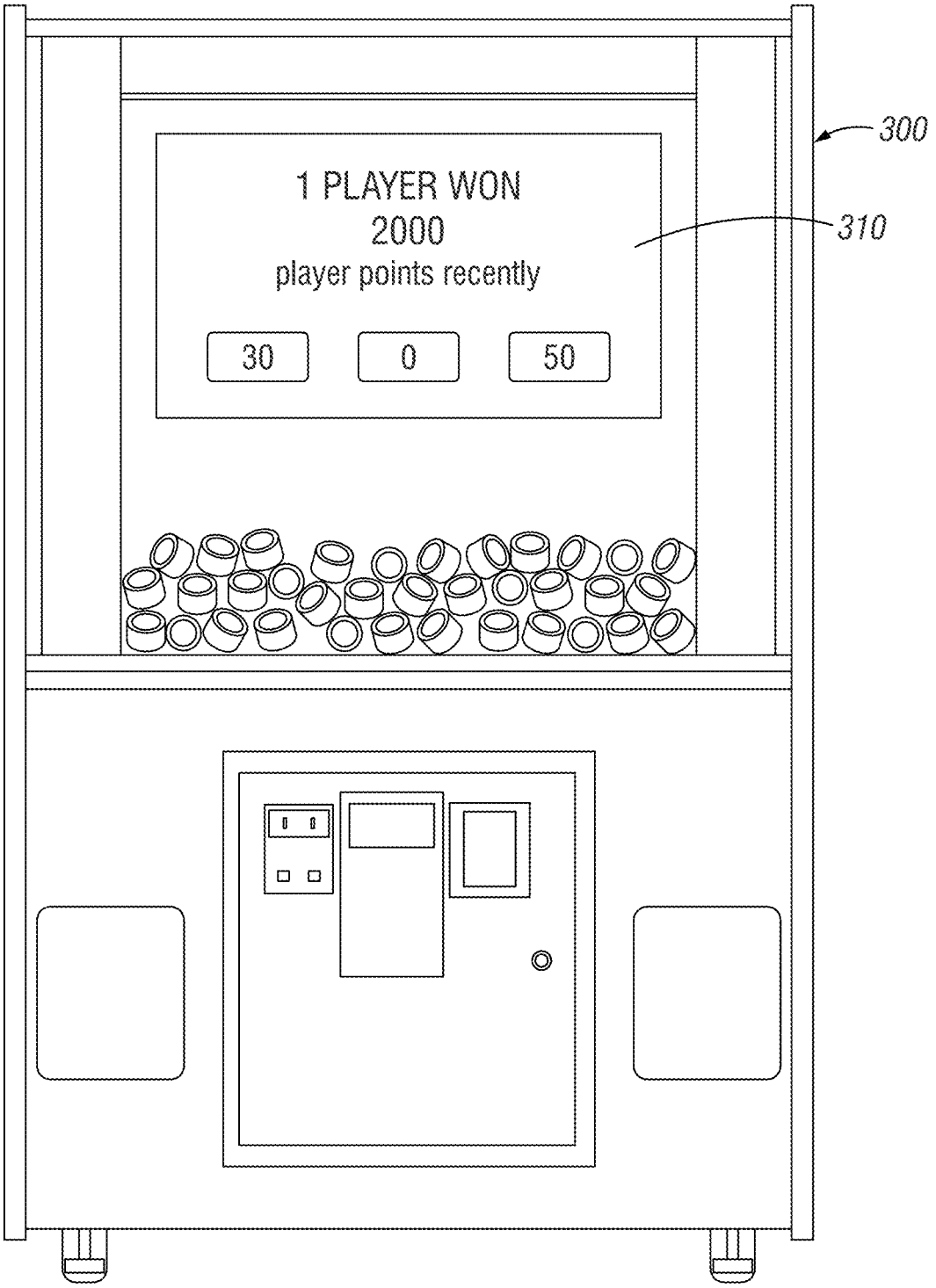
FIG. 14 is a front elevation view of a crane-style game according to one embodiment of the present invention that includes a video screen to facilitate play of game that permits redeeming points won during play for additional plays of the game or for an award.

FIG. 14 shows an arcade game 300 that permits a player to capture physical prizes using an electro-mechanical device, whereby the prizes are assigned point values, and the point values may be redeemed both to play the game and to collect awards, such as tickets. The arcade game 300 includes a video display screen 310. The display screen 310 may be a video monitor. The display screen 310 can be used to convey information to players and potential players about the game. The arcade game 300 may be similar in most respects to the game 10 described above except as noted. A crane-type grabbing mechanism that can be manipulated in the X-Y axes and dropped and raised along the Z axis is shown and described. However the feature of sensing points from an RFID tag on a captured prize and redeeming the points for an additional play of the game or an award could be associated with various capturing and grabbing mechanism that move in any or all of the axes.

To play the game, a player inserts money, or otherwise provides payment (for example by credit or points assigned to a swipe card). In exchange for the initial payment, the player is given an initial amount of points. The display screen 310 may display the total points available to the player, which initially will be the initial point value. The player then initiates play by redeeming some or all of the initial points for a single play of the game. A single play of the game involves an attempt to capture a prize or prizes using the electro-mechanical prize capturing device, which may be a crane and grabbing device as described above. The game 300 may include a button 320 that a player pushes to authorize redemption of the points to initiate a single play of the game. The redeemed points are subtracted from the total points. After the player completes a play of the game, the game determines the total value of all prizes captured and adds this to the total points. The game will display the point value of prizes won on the screen and then add this to the total points. Win or lose, the player then has the option of redeeming some of the total points to play the game again, provided the total points are more than the assigned game play point redemption value. The player also has the option of redeeming some or all of the points to receive awards, such as tickets, provided the total points are more than the assigned value for each award. Alternatively, the player can redeem the points to receive as many awards as the points can purchase and redeem the remaining points to play the game again. If the remaining points are less than the assigned game play point value, the game can be programmed to: permit an additional play of the game for less than the standard assigned game play point value, delete the remaining points and make the game available for additional play, or leave the points to be added to the initial point total for the next play of the game.

As a further alternative, the where an RFID tag might be associated with an external prize. When an item with the RFID tag is captured in the game, an image of the external prize might be displayed on the display screen 310, so the player knows what they have won. Information identifying the prize might be stored on a player's swipe card. The player can then collect the external prize from a remote location by presenting the swipe card for reading at that location. Such an arrangement might be suited for use in promoting retail stores and the like. For example, if the game is configured to promote a clothing store, the store might give a customer a token for a free play on the game. The customer would try to grab a ticket ring with an RFID tag. An RFID tag might correspond to merchandise the store has like a pair of jeans and then display it on the display screen to notify them that the customer had won. If the game is located in the store, there might not be a need for the swipe card verification. Alternatively, the game might be located remotely from the store to encourage a winner to visit the store. In addition to the display screen 310, the game may be provided with a printer that prints out an indication of the external prize won or the points accumulated by the player.

Figure 15A:
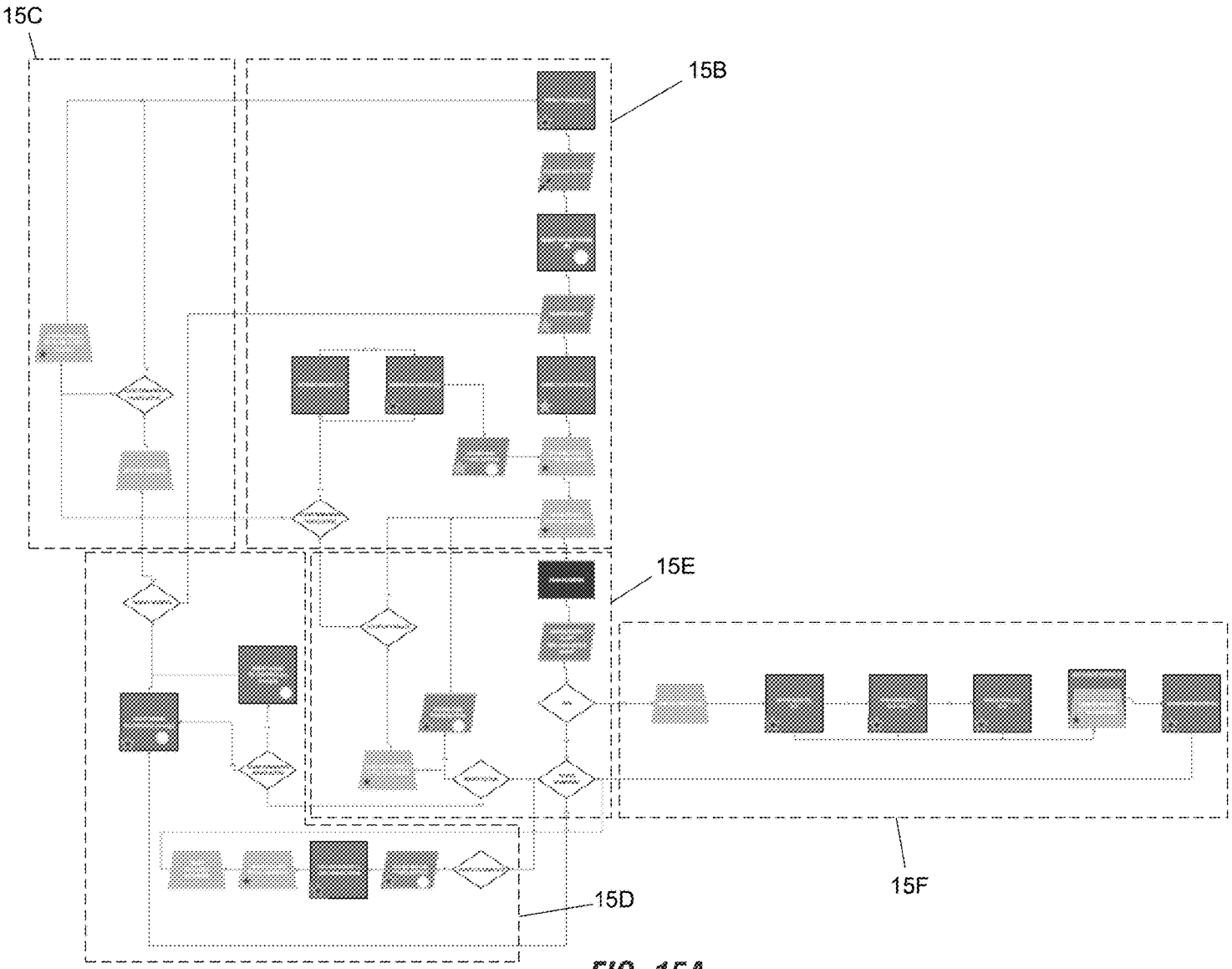
FIG. 15A is a flow-chart showing the logic and flow of a game played according to an embodiment of the invention that permits redeeming points won during play for additional plays of the game.
Figure 15B:
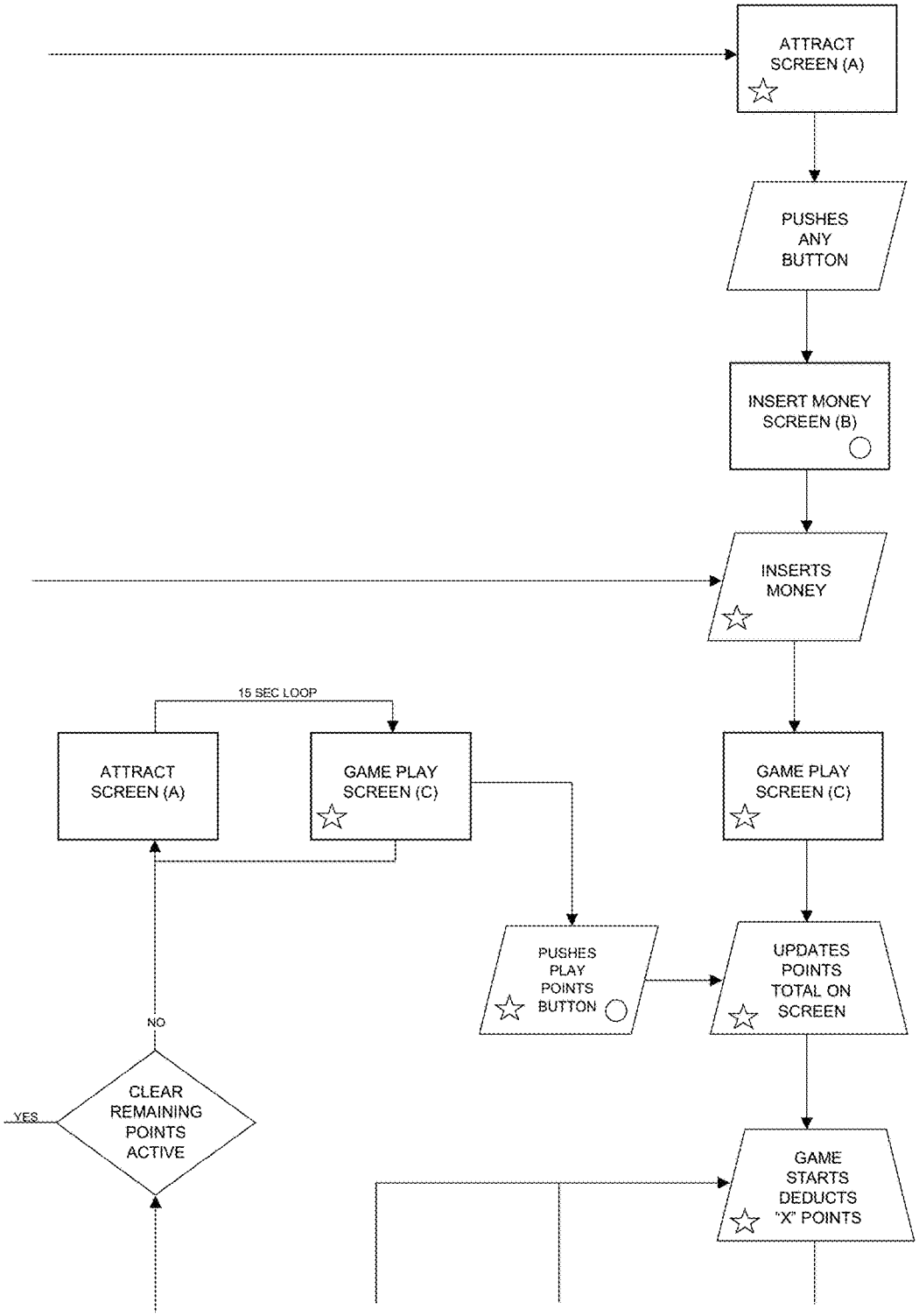
FIGS. 15B-F are enlarged views of the corresponding portions of FIG. 15A.
Figure 15C:
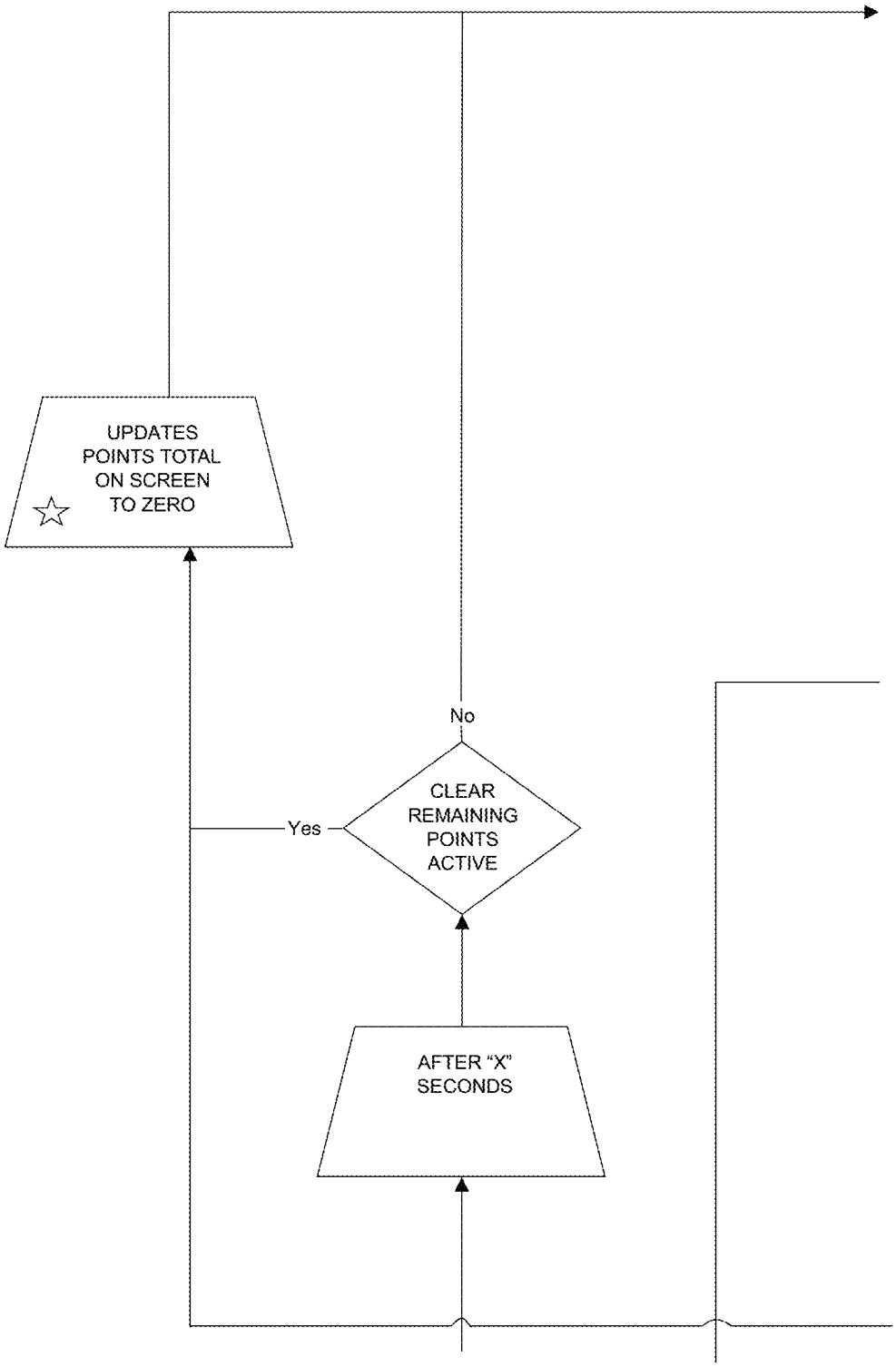
Figure 15D:
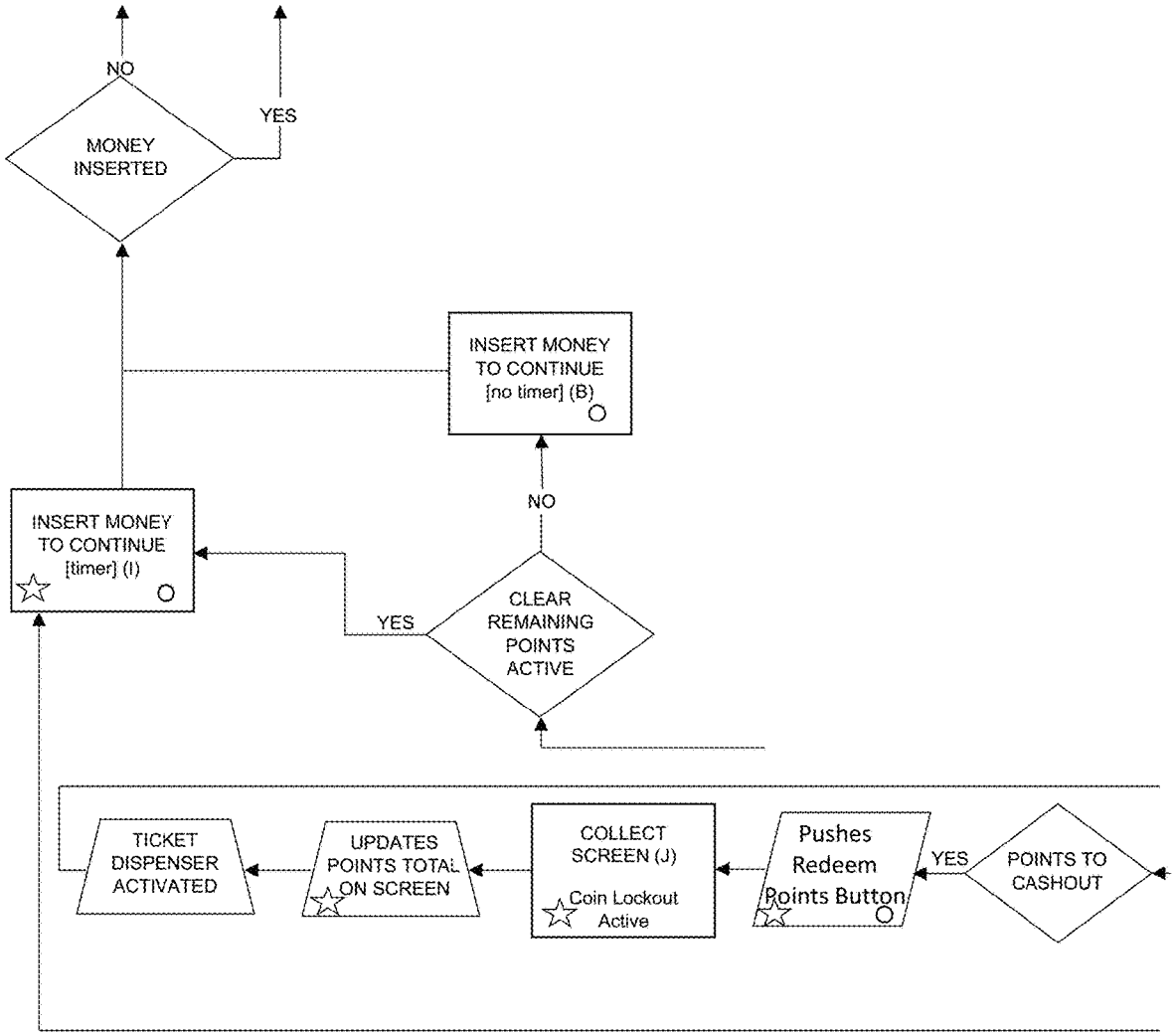
Figure 15E:
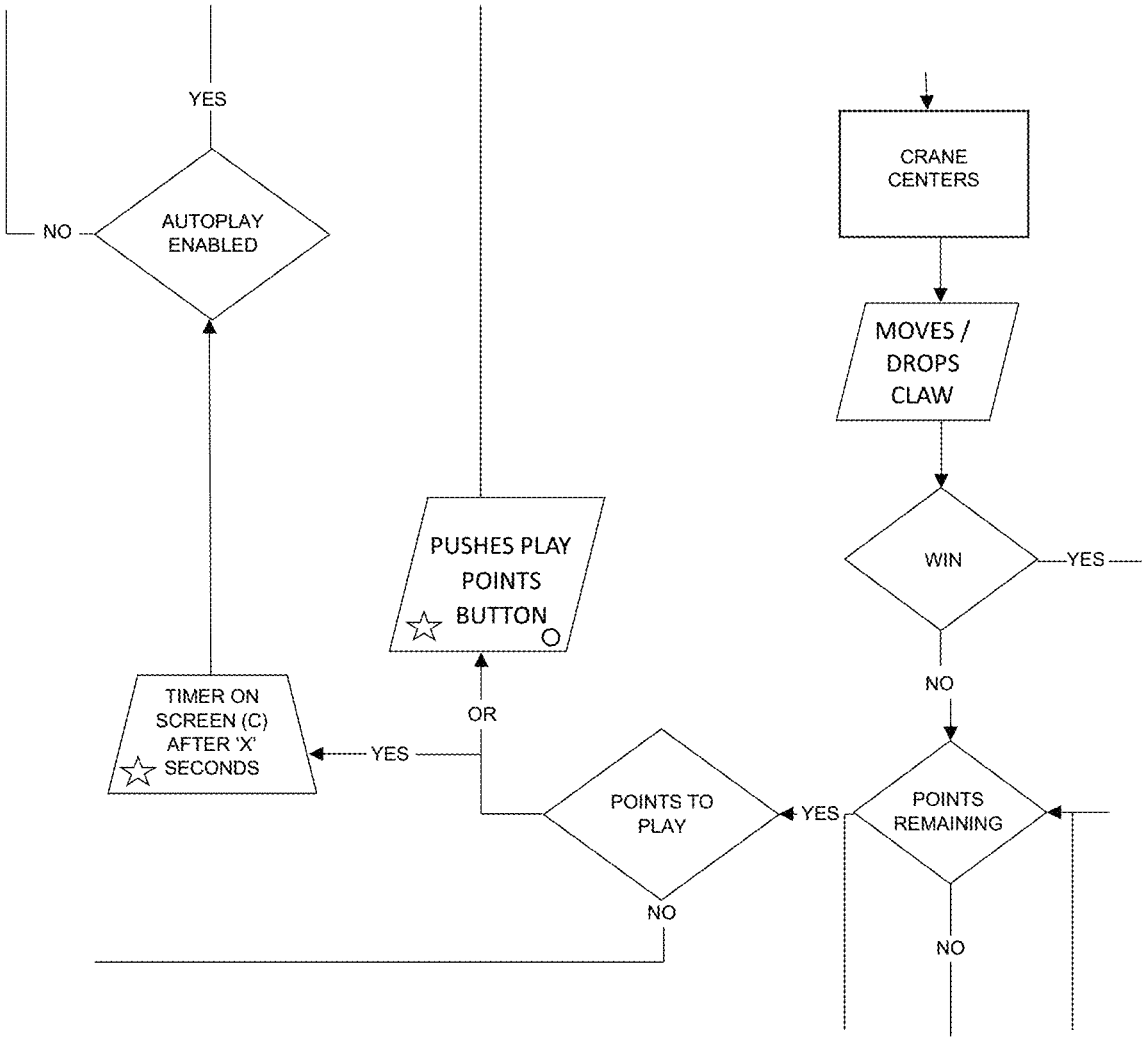
Figure 15F:
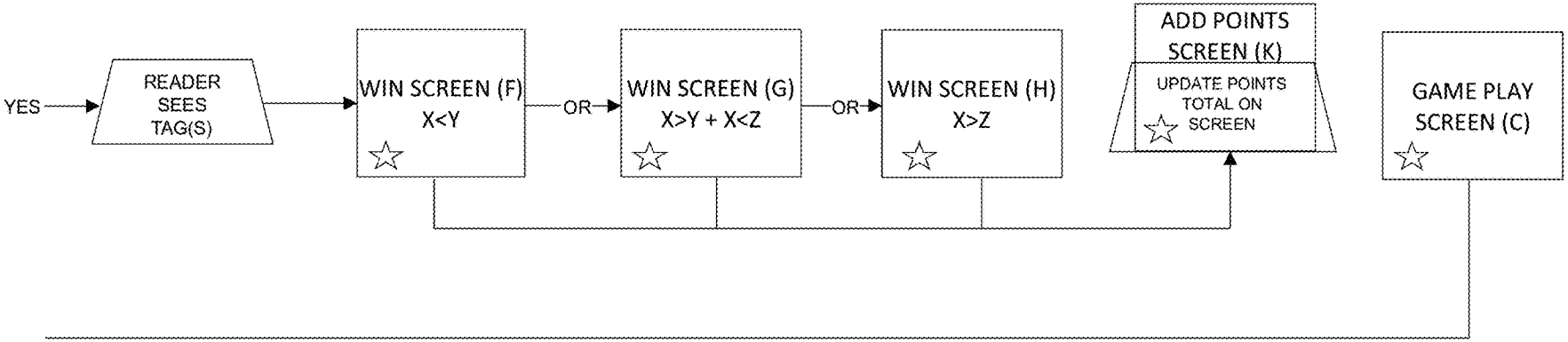
Figure 16:
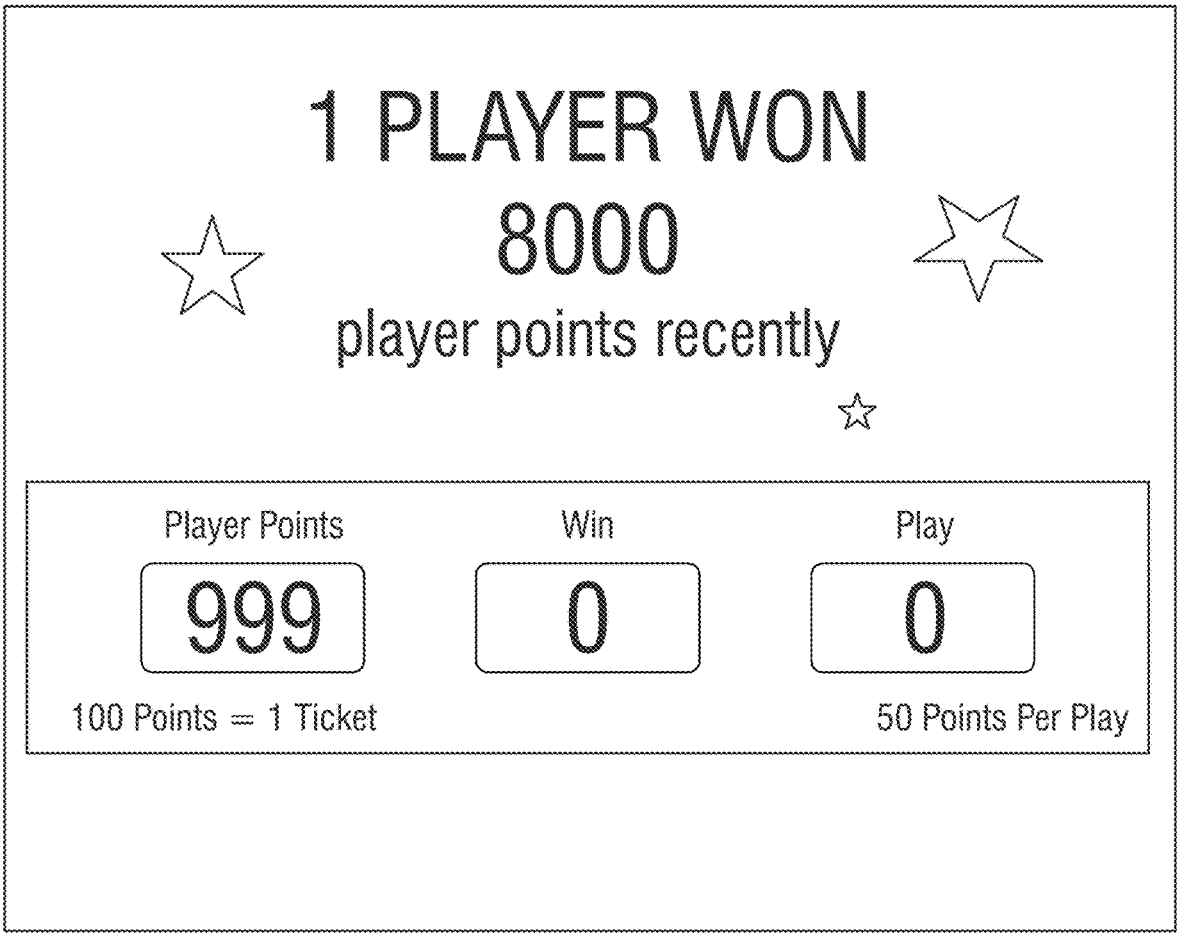
FIG. 16 is an attract screen displayed on the video screen to attract players to play the game.
Figure 17:
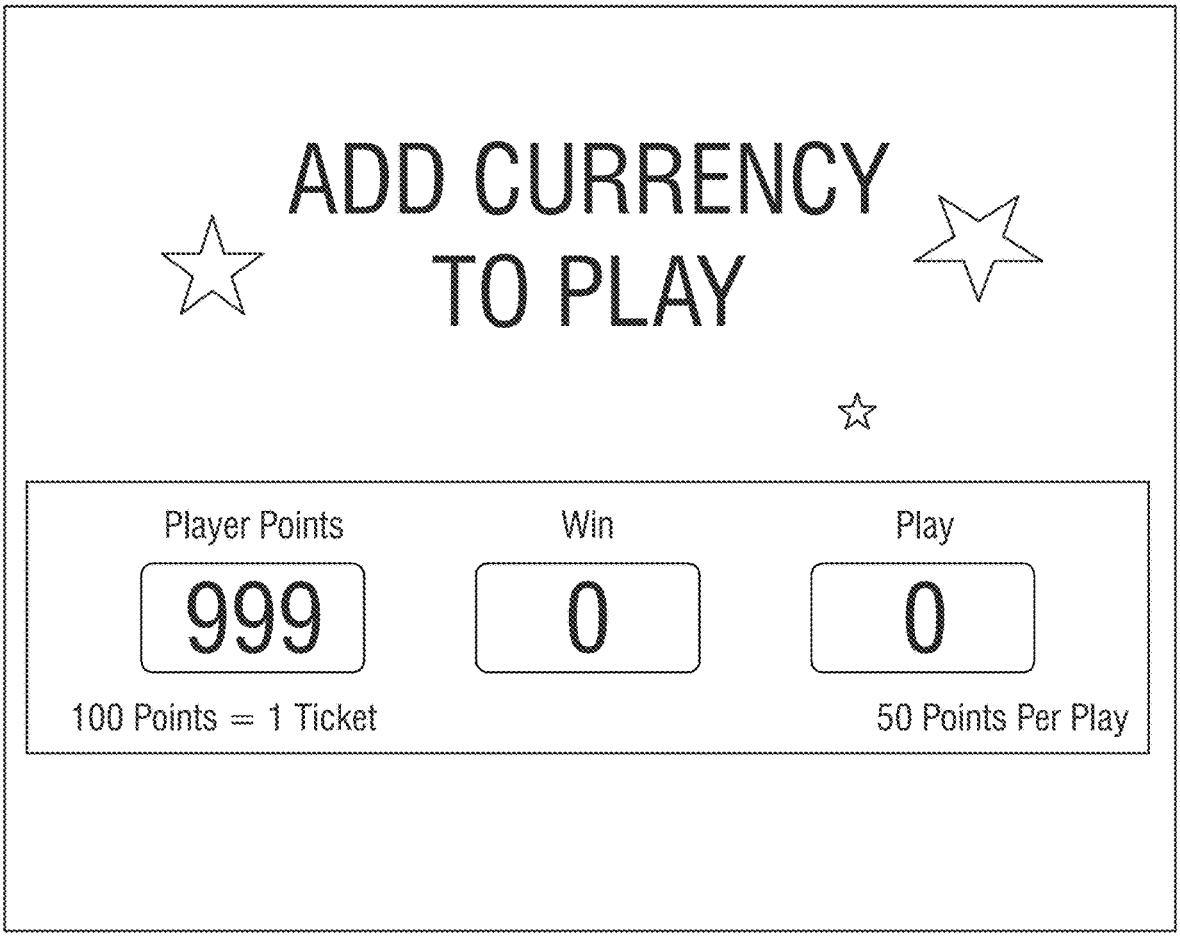
FIG. 17 is an insert money screen that is displayed on the video screen if any button the game is pushed when there is no current game session.
Figure 18:
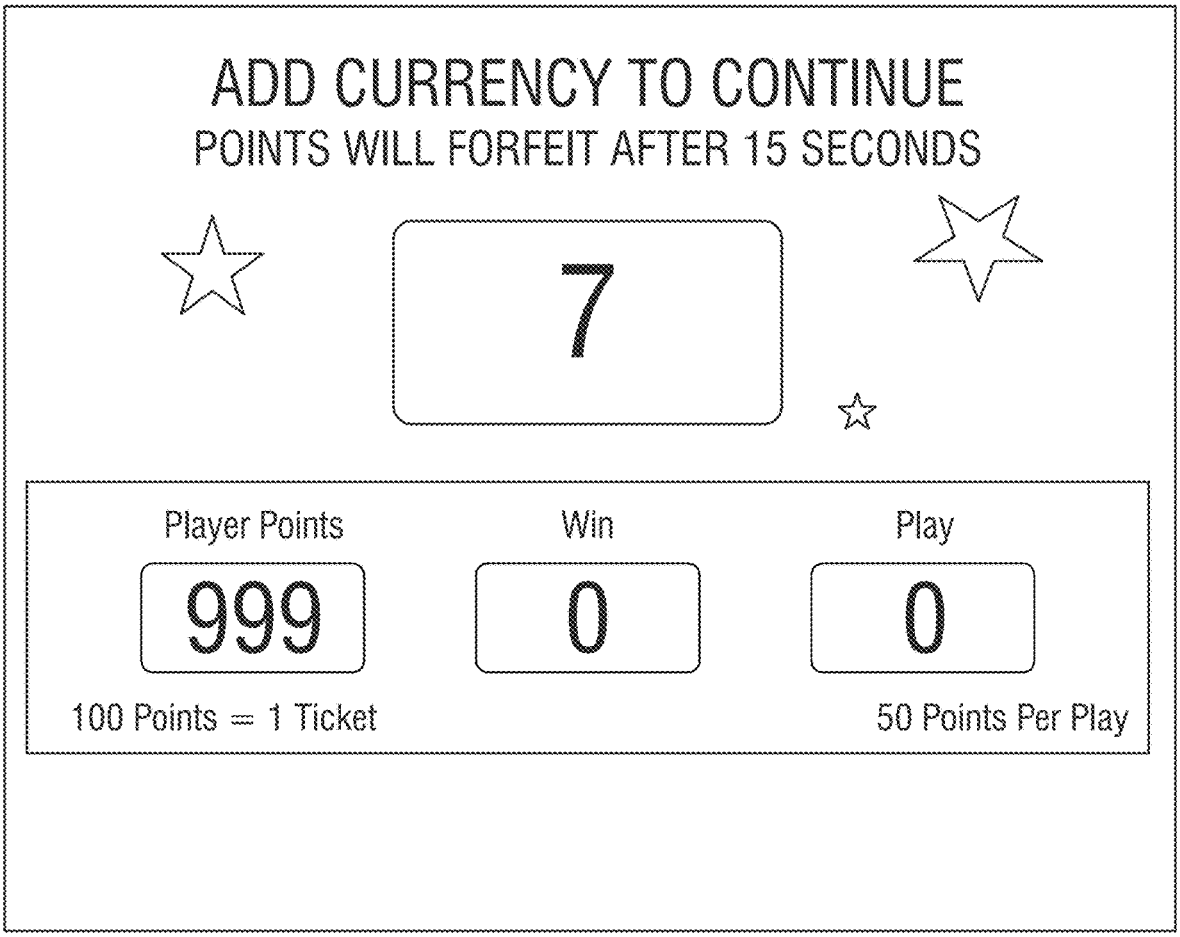
FIG. 18 is an insert money screen that is displayed on the video screen during a game session.
Figure 19:
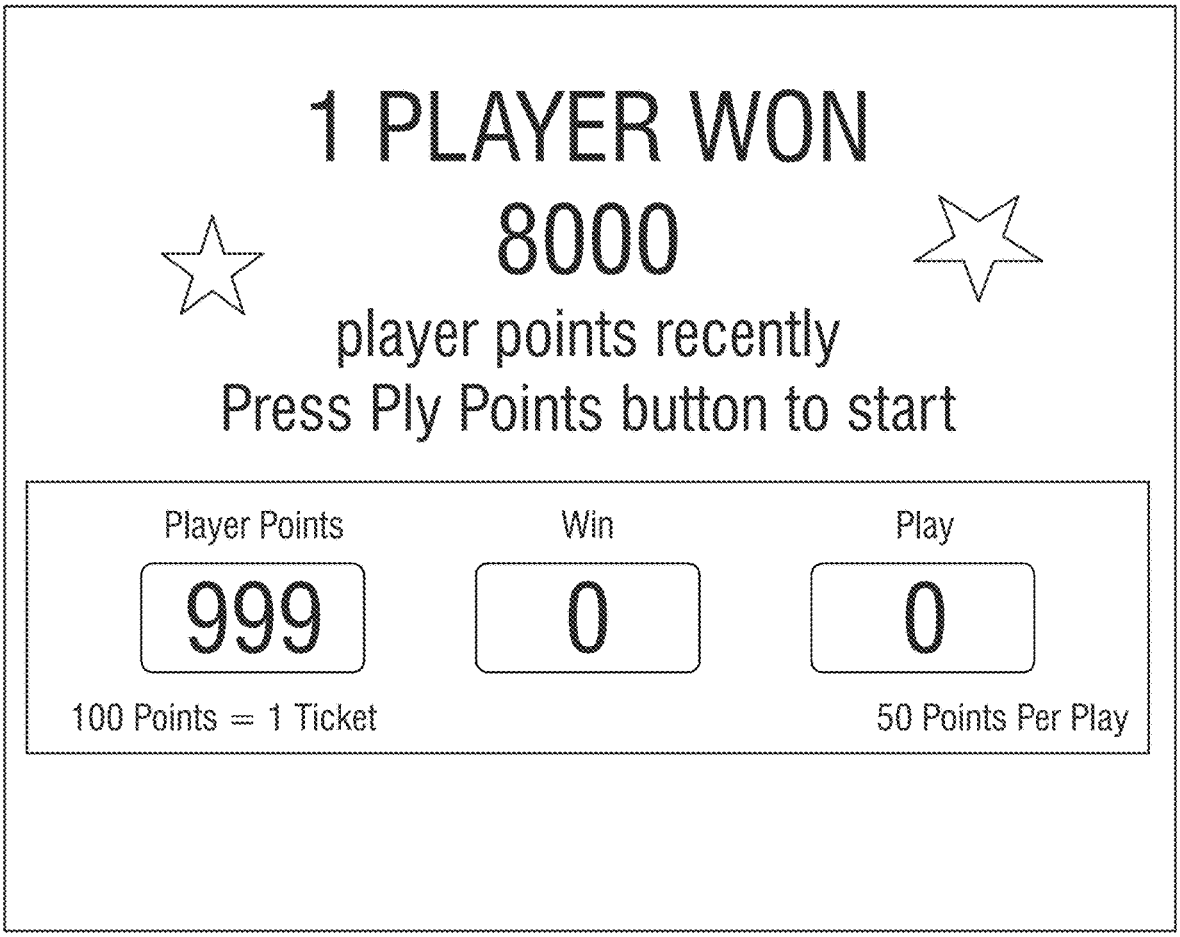
FIG. 19 is a screen that is displayed on the video screen instructing a player to press play button to redeem points to play the game.
Figure 20:
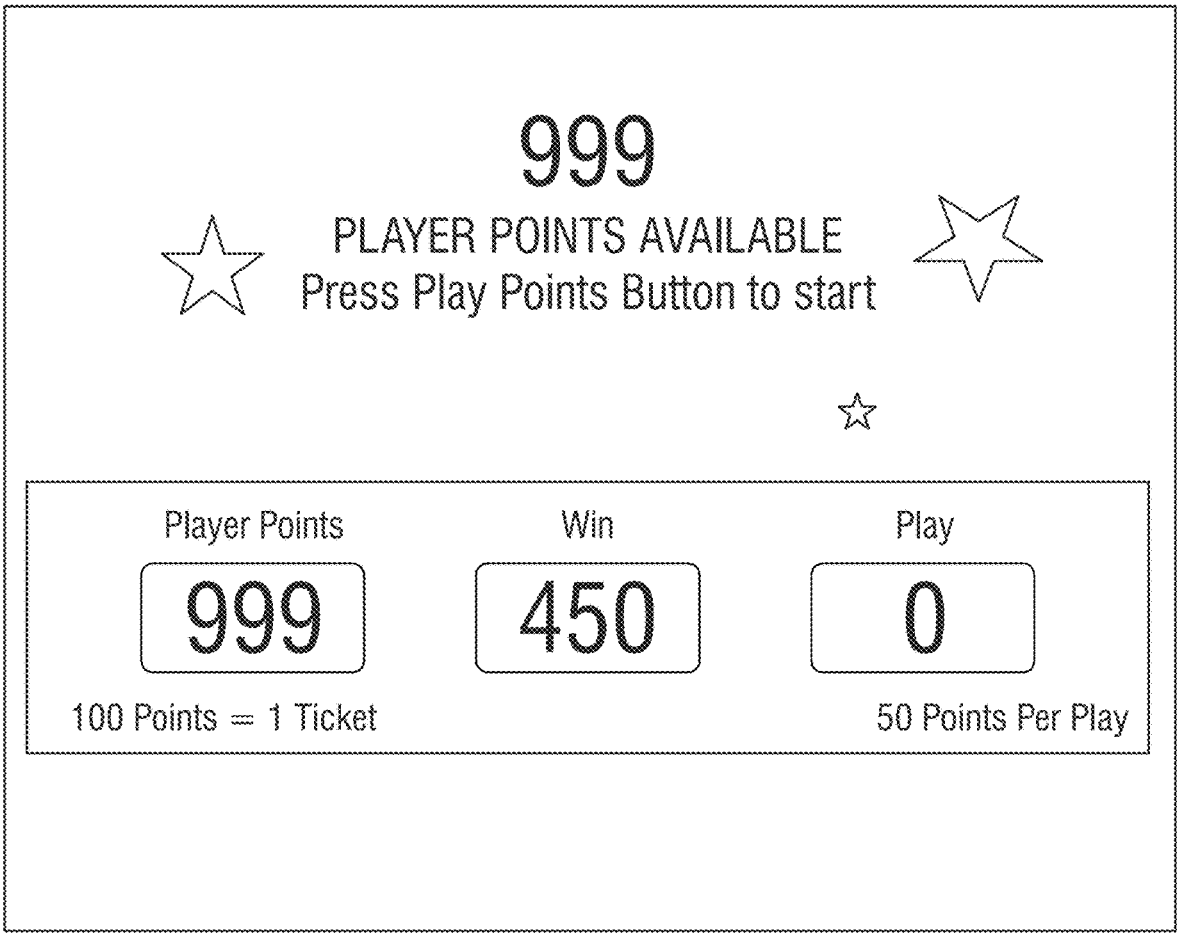
FIG. 20 is a screen that is displayed on the video screen when a player has won points that will be added to the player.
Figure 21:
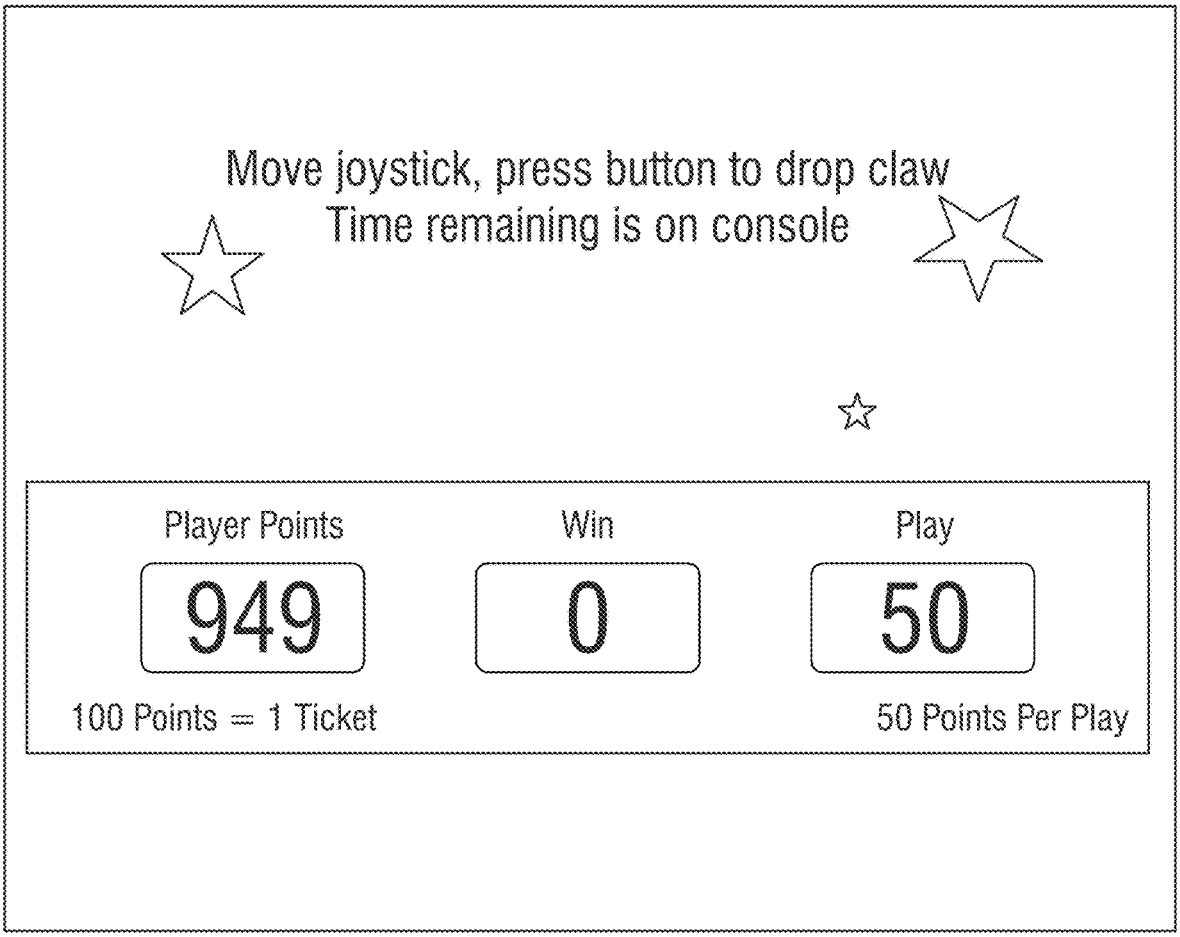
FIG. 21 is a screen that is displayed on the video screen after the player has redeemed points to play the game, instructing the player how to play.
Figure 22:
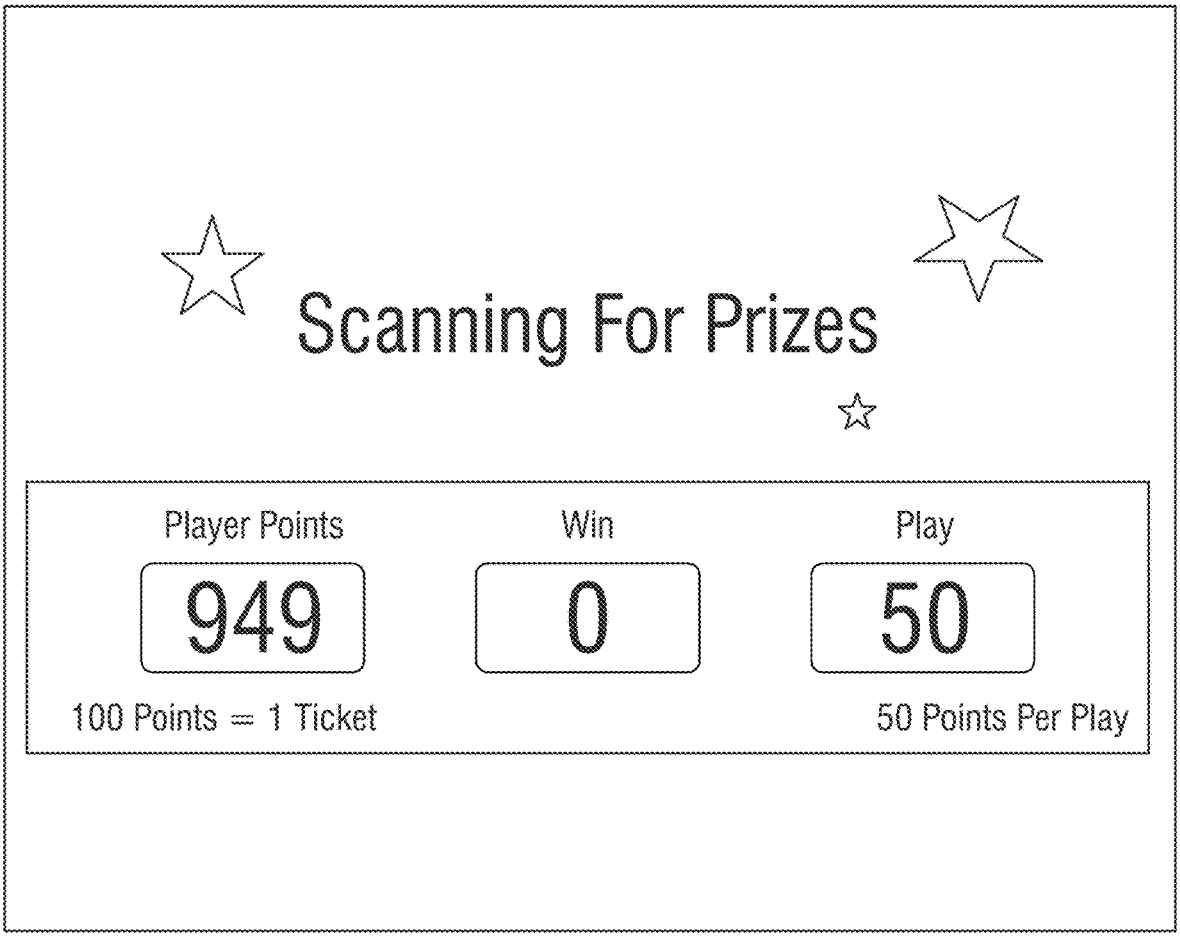
FIG. 22 is a screen that is displayed on the video screen immediately after the player has made a play while the game is scanning for any captured prize values to add to the point total.
Figure 23:
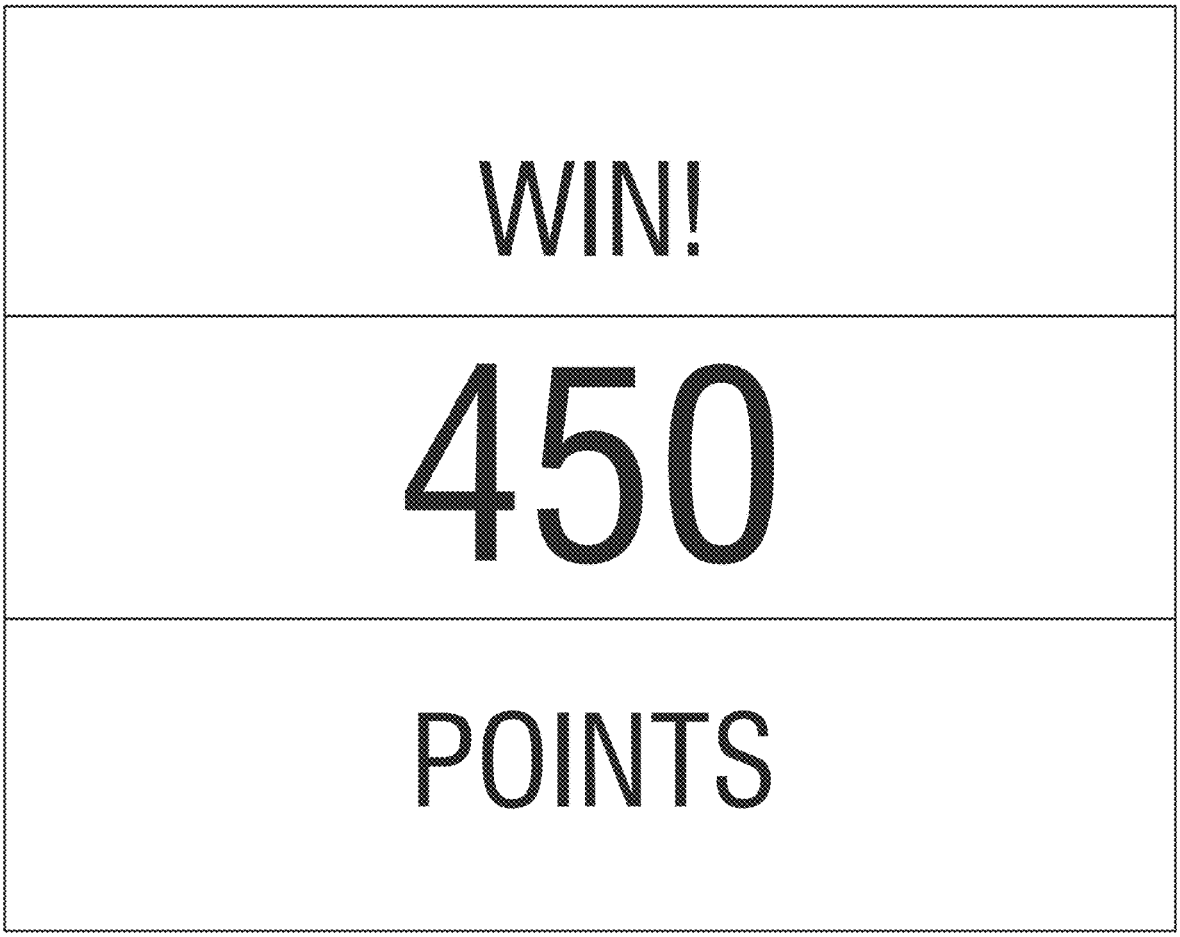
FIG. 23 is a screen that is displayed on the video screen announcing that the player has won 450 points.
Figure 24:
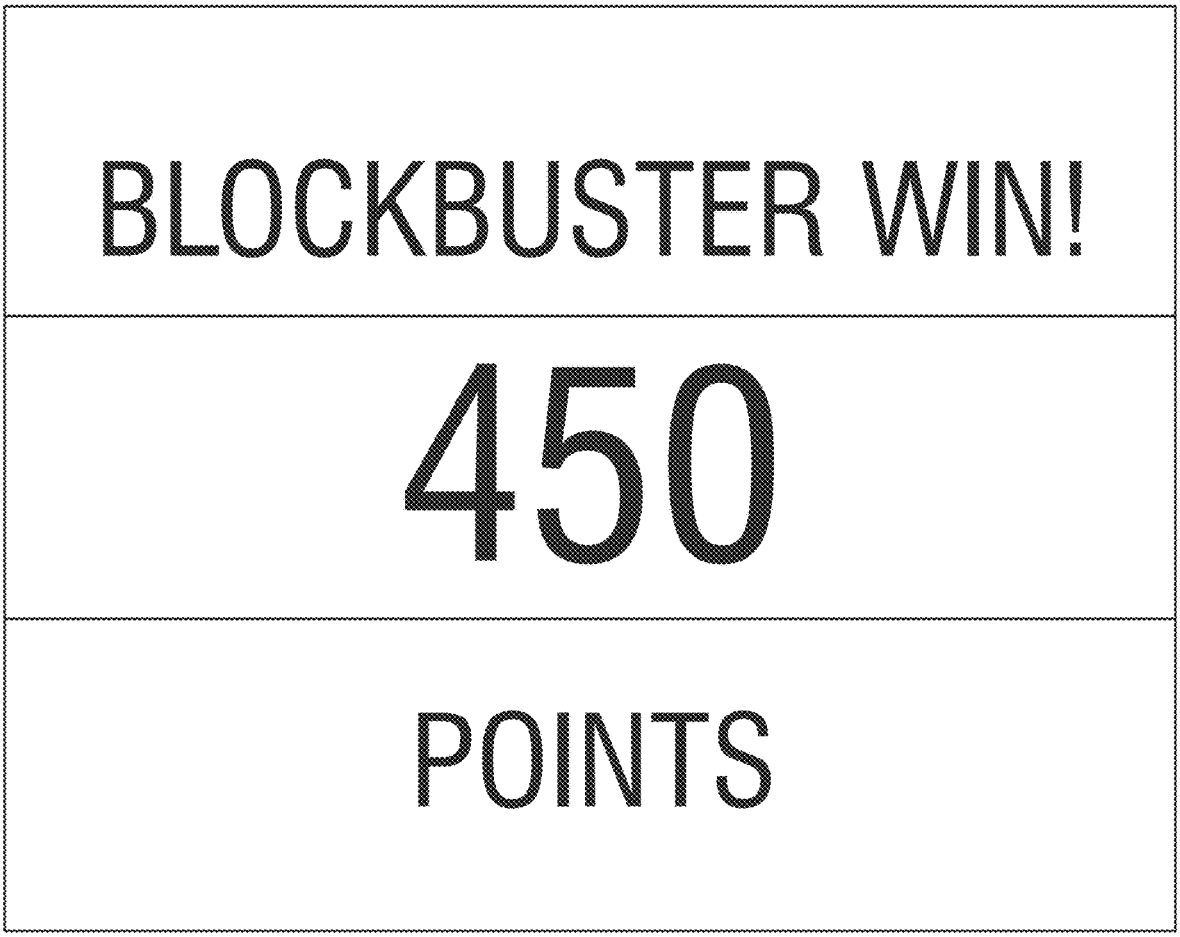
FIG. 24 is an alternative screen that is displayed on the video screen announcing that the player has won 450 points.
Figure 25A:
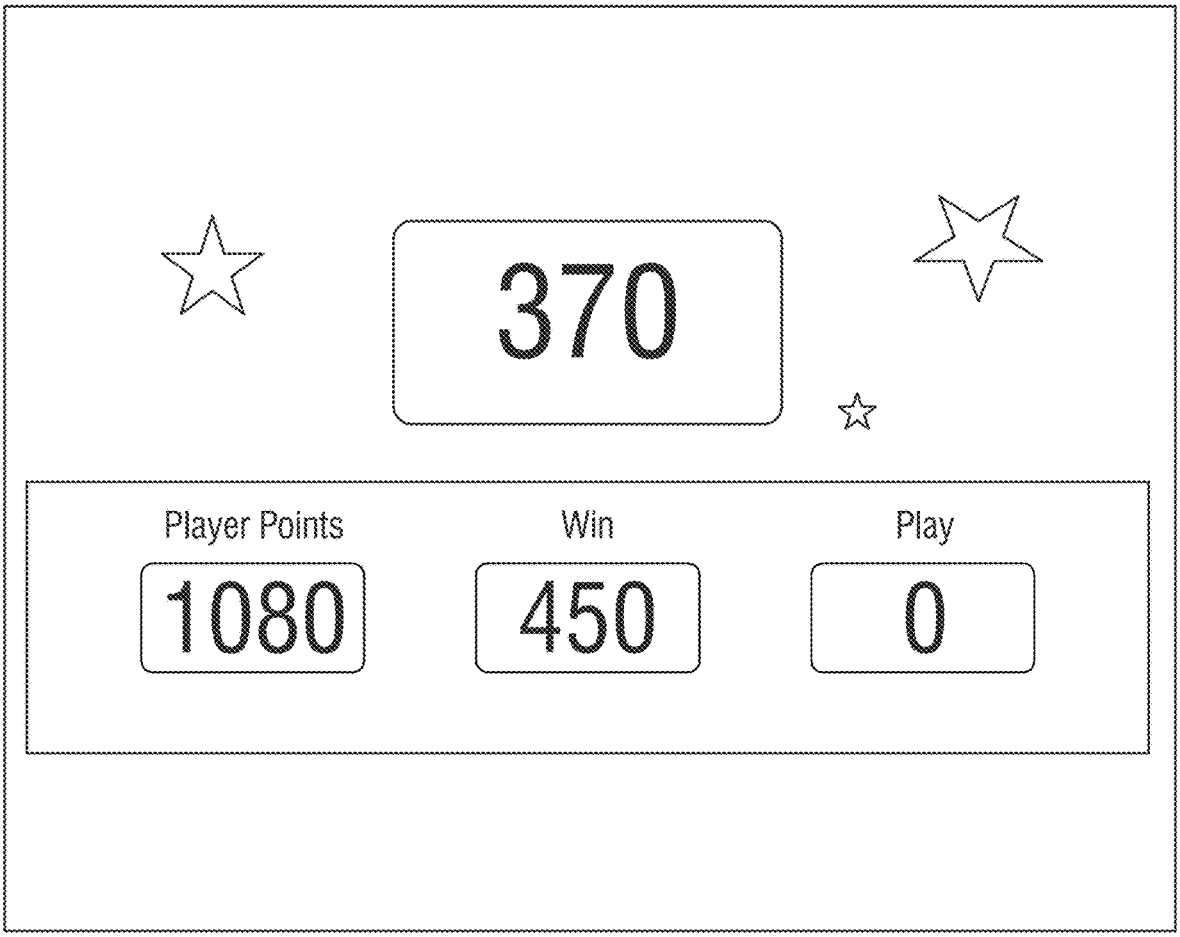
FIG. 25A is a screen that is displayed on the video screen while the game is adding the won points to the total points.
Figure 25B:
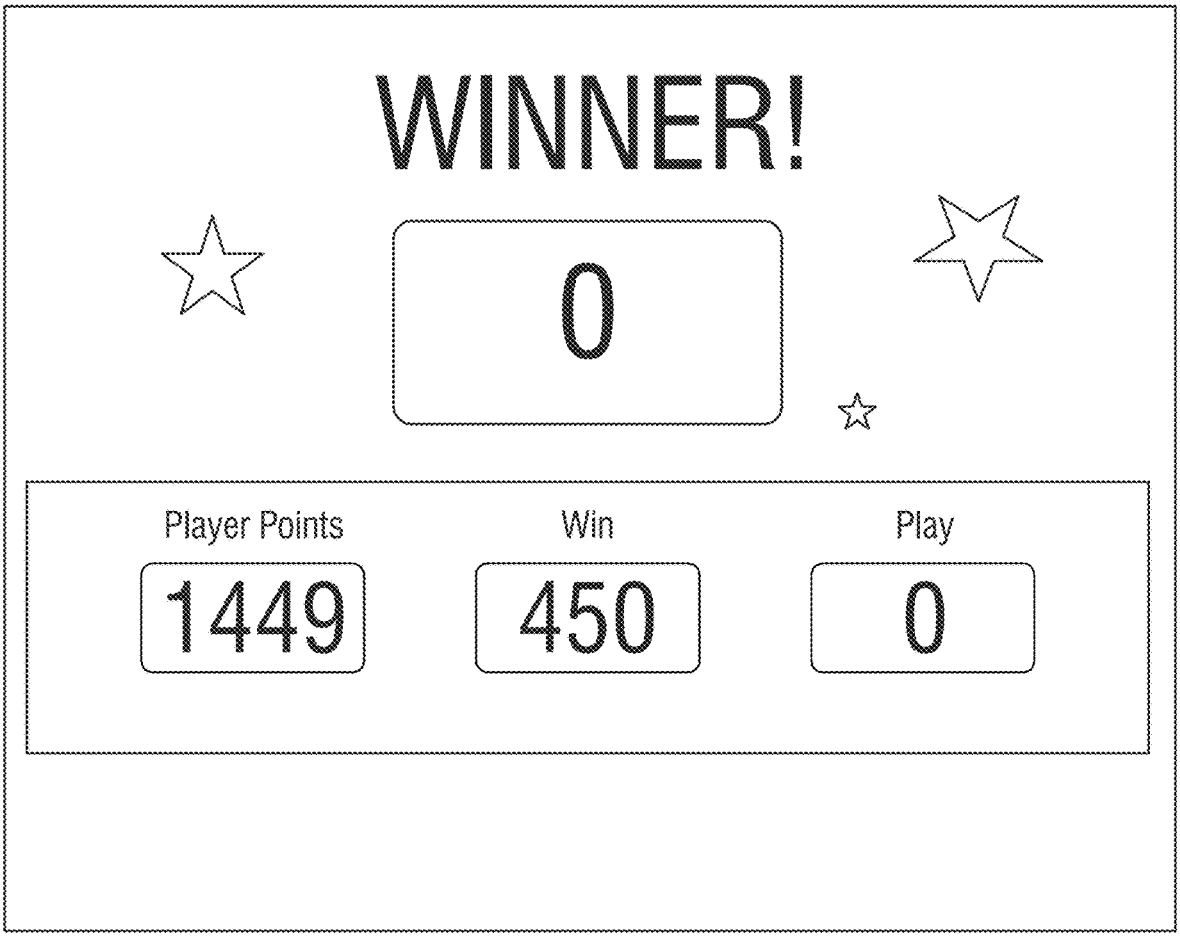
FIG. 25B is a screen that is displayed on the video screen after the game has added the won points to the point total.
Figure 26:
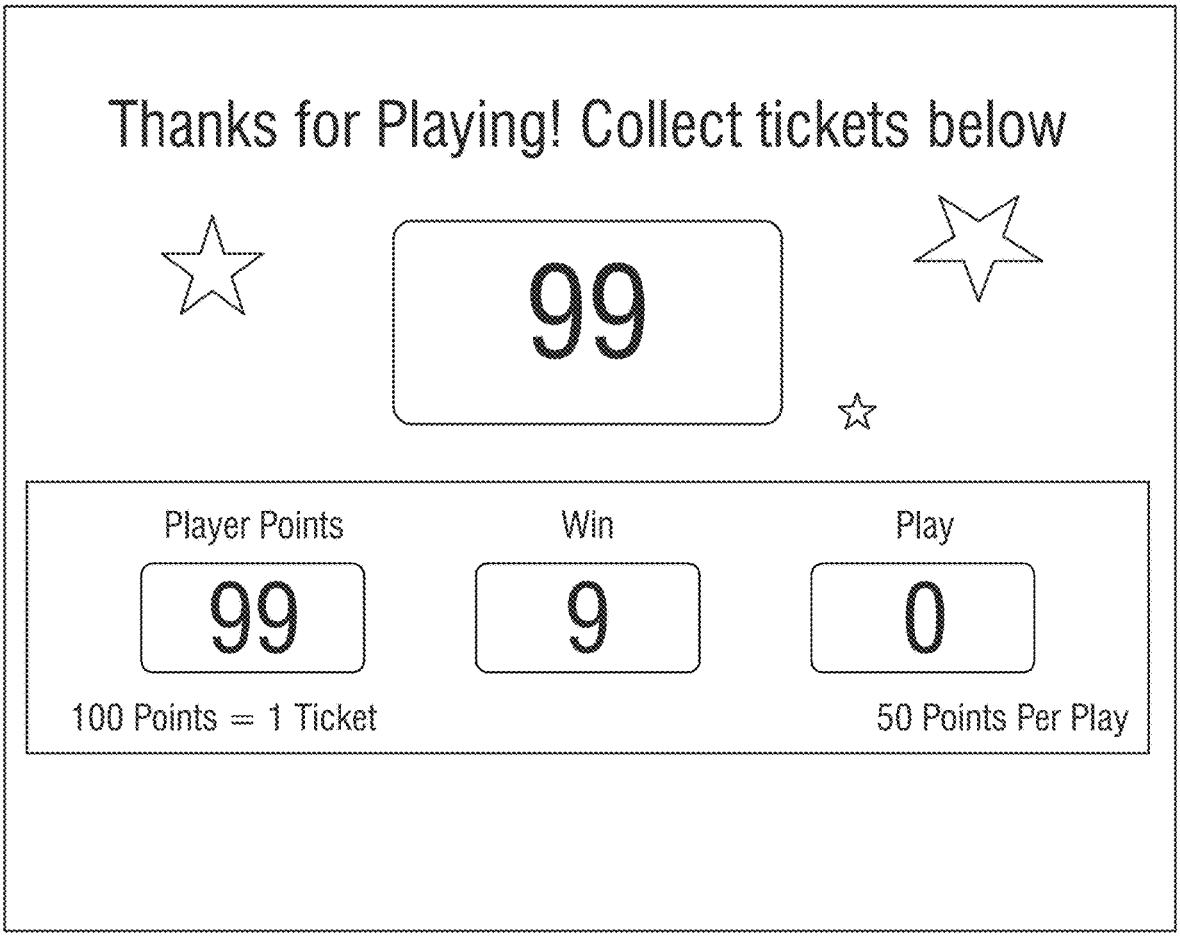
FIG. 26 is a screen that is displayed on the video screen after a player has redeemed the won points for an award of 9 tickets and has a remaining point total of 99 points.

FIG. 15A is a flow chart showing the logic and rules of a game played on arcade game 300. FIGS. 15B-F are enlarged portions of the flow chart of FIG. 15A. FIGS. 16-26 shows various displays referred to in FIGS. 15B-F that can be shown on the display screen 310 during play of the game.

Optionally, the game 300 may include additional buttons that permit a player to multiply the amount of money redeemed for a single play of the game in exchange for correspondingly multiplying the amount of points awarded when a prize is captured.

FIG. 27 shows a game configuration screen that can be used by the game operator so set various parameters of the game. This screen is not available to players and can only be accessed by an operator who has access to the computer processor. The configuration screen may be displayed on the display screen 310 and the operator may provide input using the game controls. Through the configuration screen a user can set parameters such as the standard assigned game play point value that gets subtracted from the point total for each play of the game. This same configuration screen can be used to assign the point value for each award, such as points per ticket value. The configuration screen is used to set the initial point value assigned per amount of money inserted, for example 50 points for every dollar. The configuration screen can be used to set the multiplication values for the multiplication buttons.

Figure 28:
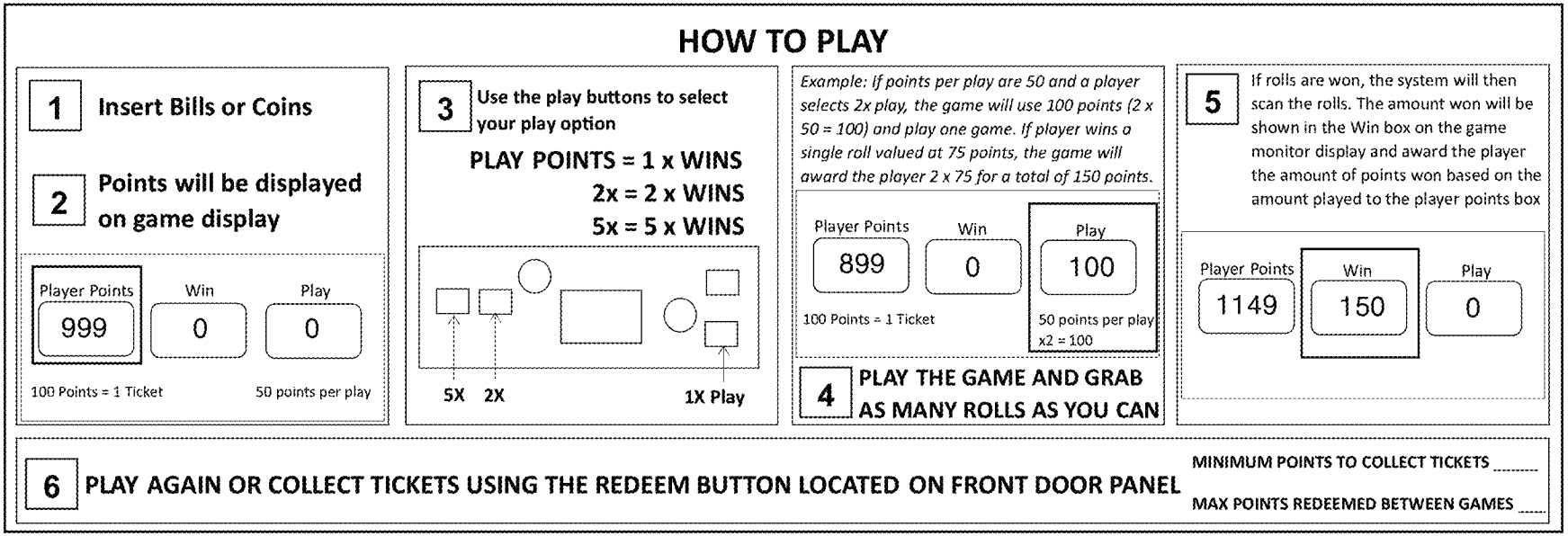
FIG. 28 is a display that may be posted on the game instructing players how to play the game and what the rules of the game are.

FIG. 28 shows an instruction display that may be provided permanently on the game to instruct players how to play the game and what the rules are.

The present invention contemplates numerous variations, options and alternatives, and is not to be limited to the specific embodiments described herein. Other changes are considered to be part of the present invention.

What is claimed is:

1. An arcade game comprising:

a housing;

a plurality of physical items within the housing;

a plurality of markers, each of the markers being attached to a corresponding one of the physical items;

an electro-mechanical prize capturing device mounted in the housing adapted to be at least partially controlled by a player using game controls to capture at least one physical item from a display area within the housing and move the captured physical item to a marker reading area within the housing;

a reader device adapted to read the markers attached to the physical items, wherein each marker is programmed with a point value;

a computer processor adapted to receive a signal from the reader device indicating the point value for each marker of a captured physical item, the computer processor adapted to calculate a point total for each game session, wherein the point total is equal to a starting point total minus redeemed points plus the point values for the markers of all captured physical items;

a display screen that shows the point total;

wherein the computer processor is adapted to permit a player to redeem a portion of the point total for plays of the game and for an award; and a multiplier button, whereby selection of the multiplier button by the player causes the portion of the point total redeemed for plays of the game to be multiplied by a multiplication factor and causes the captured item's marker point value to be multiplied by the multiplication factor.

2. The arcade game of claim 1, wherein the captured physical items remain within the housing and are not dispensed to the player.

3. The arcade game of claim 1, wherein the prize capturing device is a crane with a grabber mechanism that can be manipulated by a control mounted on an exterior of the housing.

4. The arcade game of claim 1, wherein the items are rolls of tickets.

5. The arcade game of claim 1, wherein the markers are RFID tags and the reader is an RFID reader.

6. The arcade game of claim 1, further comprising a ticket dispenser, and wherein the award is tickets.

7. The arcade game of claim 1, further comprising a swipe card writer, and wherein the prize is a ticket value electronically transferred to a player's swipe card.

8. The arcade game of claim 1, further comprising a token item dispenser, and wherein the award is a token item.

9. The arcade game of claim 1, wherein the computer processor is adapted to receive inputs from the player using the display screen and game controls to redeem points to play a game or redeem a number of points for the award.

10. The arcade game of claim 1, wherein the computer processor is adapted to receive inputs from an operator using the display screen and game controls to set a standard number of points to be redeemed to play the game and a standard number of points to be redeemed per award.

11. The arcade game of claim 1, further comprising a captured item orienting and singulating mechanism associated with the marker reader area to move the captured items past the reader device.

12. The arcade game of claim 1, wherein the electro-mechanical device is of the type that acquires and releases the item into the reading area.

13. The arcade game of claim 12, wherein the electro-mechanical device moves in the X or Y axis.

14. The arcade game of claim 12, wherein the electro-mechanical device moves in the X, Y, and Z axes.

15. The arcade game of claim 1, wherein the display screen is adapted to display the award.

16. The arcade game of claim 1, further comprising a printer to print an indication of the point value or award won by the player.

17. An arcade game comprising:

a housing;

a plurality of physical items within the housing;

a plurality of markers, each of the markers being attached to a corresponding one of the physical items;

an electro-mechanical prize capturing device mounted in the housing adapted to be at least partially controlled by a player using game controls to capture at least one physical item from a display area within the housing and move the captured physical item to a marker reading area within the housing;

a reader device adapted to read the markers attached to the physical items, wherein each marker is programmed with a point value;

a computer processor adapted to receive a signal from the reader device indicating the point value for each marker of a captured physical item, the computer processor adapted to calculate a point total for each game session, wherein the point total is equal to a starting point total minus redeemed points plus the point values for the markers of all captured physical items;

a display screen that shows the point total;

wherein the computer processor is adapted to permit a player to redeem a portion of the point total for plays of the game and for an award; and further wherein the computer processor is adapted to receive inputs from an operator using the display screen and game controls to set a standard number of points to be redeemed to play the game and a standard number of points to be redeemed per award.

18. The arcade game of claim 17, further comprising a captured item orienting and singulating mechanism associated with the marker reader area to move the captured items past the reader device.

19. The arcade game of claim 17, further comprising a multiplier button, whereby selection of the multiplier button by the player causes the portion of the point total redeemed for plays of the game to be multiplied by a multiplication factor and causes the captured item's marker point value to be multiplied by the multiplication factor.

* * * * *